US012746444B2

(12) United States Patent
Pavony

(10) Patent No.: US 12,746,444 B2
(45) Date of Patent: Sep. 29, 2026

(54) PROJECTILE TOSS TARGET GAME APPARATUS

(71) Applicant: Shambolic Enterprise LLC, Brooklyn, NY (US)

(72) Inventor: Eric Harris Pavony, Brooklyn, NY (US)

(73) Assignee: SHAMBOLIC ENTERPRISE LLC, Brooklyn, NY (US)

( * ) Notice: Subject to any disclaimer, the term of this patent is extended or adjusted under 35 U.S.C. 154(b) by 398 days.

(21) Appl. No.: 18/378,751

(22) Filed: Oct. 11, 2023

(65) Prior Publication Data

US 2024/0207707 A1 Jun. 27, 2024

Related U.S. Application Data

(60) Provisional application No. 63/387,925, filed on Dec. 16, 2022.

(51) Int. Cl.
*A63B 67/06* (2006.01)
*A63B 63/08* (2006.01)

(52) U.S. Cl.
CPC ..... *A63B 67/06* (2013.01); *A63B 63/08* (2013.01); *A63B 2067/063* (2013.01); *A63B 2210/50* (2013.01)

(58) Field of Classification Search
CPC ..... A63B 67/06; A63B 63/08
USPC ..... 273/348, 402
See application file for complete search history.

(56) References Cited

U.S. PATENT DOCUMENTS

| | | | | |
|---|---|---|---|---|
| 1,188,707 | A | 6/1916 | Watanabe | |
| 3,424,463 | A | 1/1969 | Matthews | |
| 3,490,769 | A | 1/1970 | Torbett | |
| 4,240,637 | A | 12/1980 | Cross et al. | |
| 7,229,072 | B2 | 6/2007 | DiFrancesco, Jr. | |
| 8,807,569 | B1 * | 8/2014 | Davis | F41J 5/20 473/570 |
| 2008/0001354 | A1 | 1/2008 | Ting | |
| 2009/0049860 | A1 | 2/2009 | Manner et al. | |
| 2012/0038109 | A1 * | 2/2012 | Battista | A63F 9/0204 273/402 |
| 2015/0108719 | A1 * | 4/2015 | Devine | A63B 67/06 273/402 |
| 2015/0231467 | A1 | 8/2015 | Sciandra | |

OTHER PUBLICATIONS

International Search Report for corresponding application PCT/US2023/083061 filed Dec. 8, 2023; Mail Date Feb. 16, 2024.
Written Opinion for corresponding application PCT/US2023/083061 filed Dec. 8, 2023; Mail Date Feb. 16, 2024.

* cited by examiner

*Primary Examiner* — Thomas M Sember
(74) *Attorney, Agent, or Firm* — CANTOR COLBURN LLP

(57) ABSTRACT

A projectile toss target game apparatus including a planar playing surface arranged at an angle to a ground surface, an opening formed through the planar playing surface, the opening being of sufficient size and shape to allow passage of the projectile therethrough, and a recessed area formed in the playing surface proximate to the opening, the recessed area being of sufficient size and shape to retain the projectile stationary upon the angled playing surface.

20 Claims, 21 Drawing Sheets

PROJECTILE TOSS TARGET GAME APPARATUS

CROSS REFERENCE TO RELATED APPLICATION

This application is related to and claims the benefit of U.S. Provisional Patent Application No. 63/387,925 filed on Dec. 16, 2022, the entire contents of which are herein incorporated by reference.

TECHNICAL FIELD

The disclosure relates to the field of projectile toss target games in general and, in particular, to a projectile toss target game that incorporates a variety of target elements on the game apparatus.

BACKGROUND

Projectile toss target games are both common and historical. However, such known games often provide a player with limited target options. This restricts the scope of the game, diminishes strategic play, and limits development of advanced skills. These drawbacks can have the effect of limiting a player's enjoyment of the game and reducing playing time. Also, these traditional toss target games are often floor-based and require an excessive amount of space. As such, these games do not lend themselves to indoor play at home or in commercial establishments, or in any setting where space is limited.

An example of an existing projectile toss target game is that which is commonly known as "cornhole". This game presents players with two opposing floor mounted playing surfaces, each having a single target. A typical cornhole court is 10-12 feet wide and a minimum of 40-45 feet long. The excessive size required for cornhole essentially prohibits the game from being played in a commercial establishment such as a bar or restaurant, or in the family room or basement of a home. Moreover, the single target provided on each opposing playing surface presents limited challenge to players and does not allow for strategic or creative play.

In another example, "horseshoes" is a known projectile toss target game which presents players with opposing target stakes placed in the ground forty feet apart. Typically, a pit of sand is formed around each stake, the pits often measuring at least three feet by six feet. Here again, the large size of the playing area required for horseshoes prohibits its enjoyment in many settings including domestic and commercial. Additionally, with only a single target available to players, excitement, creativity, and strategic team play are limited.

What is needed is a projectile toss target game apparatus that does not require an excessive amount of space and which challenges players with multiple targets, encouraging skill development, creativity, and strategic play, resulting in enhanced enjoyment and prolonged playing times.

BRIEF SUMMARY

A projectile toss target game apparatus is provided including a planar playing surface arranged at an angle to a ground surface, an opening formed through the planar playing surface, the opening being of sufficient size and shape to allow passage of the projectile therethrough, and a recessed area formed in the playing surface proximate to the opening, the recessed area being of sufficient size and shape to retain the projectile stationary upon the angled playing surface.

The disclosure further provides a projectile toss target game apparatus having a planar playing surface arranged at an angle to a ground surface, sidewalls extending around sides and a rear of the playing surface and extending upwardly from the playing surface, an opening formed through the planar playing surface, the opening being of sufficient size and shape to allow passage of the projectile therethrough, a recessed area formed in the playing surface proximate to the opening, the recessed area being of sufficient size and shape to retain the projectile stationary upon the angled playing surface, a gap delimited between the rear of the playing surface and the sidewall, where the gap is configured to receive the projectile when over tossed, and a blocking member removably disposed proximate to the rear of the playing surface, where the blocking member extends upwardly from the playing surface and is of sufficient height to prevent passage of the over tossed projectile into the gap and to redirect a path of the projectile.

Also provided herein is a projectile toss target game apparatus including a rectangular planar playing surface arranged at an angle to a ground surface, a support element disposed beneath the playing surface to maintain the playing surface at a table height, a right sidewall extending along a right side edge of the playing surface, a left sidewall extending along a left side edge of the playing surface, and a rear sidewall extending along a rear edge of the playing surface, the right, left, and rear sidewalls extending upwardly from the playing surface, a gap delimited between the rear edge of the playing surface and the rear sidewall, where the gap is configured to receive the projectile when over tossed, a blocking member moveable between a plurality of positions proximate to the rear edge of the playing surface, where the blocking member extends upwardly from the playing surface and is of sufficient height to prevent passage of the over tossed projectile into the gap and to redirect a path of the projectile, an aperture formed through the playing surface, a disc shaped insert mountable within the aperture, where the a disc shaped insert comprises a circular opening at a center thereof, where the disc shaped insert further comprises a recessed area extending concentrically around the opening and comprising a plurality of arcuate shaped indented compartments divided by radially extending raised surfaces, where the raised surfaces are coplanar with the playing surface and the indented compartments each have a base which extends between the respective raised surfaces where each base is parallel to and non-coplanar with the playing surface, where the opening is of sufficient size and shape to allow passage of the projectile therethrough and the recessed area is of sufficient size and shape to retain the projectile stationary upon the angled playing surface.

BRIEF DESCRIPTION OF THE DRAWINGS

For a more complete understanding of this disclosure, reference is now made to the following brief description, taken in connection with the accompanying drawings and detailed description, wherein like reference numerals represent like parts, in which.

DETAILED DESCRIPTION

Figure 1:
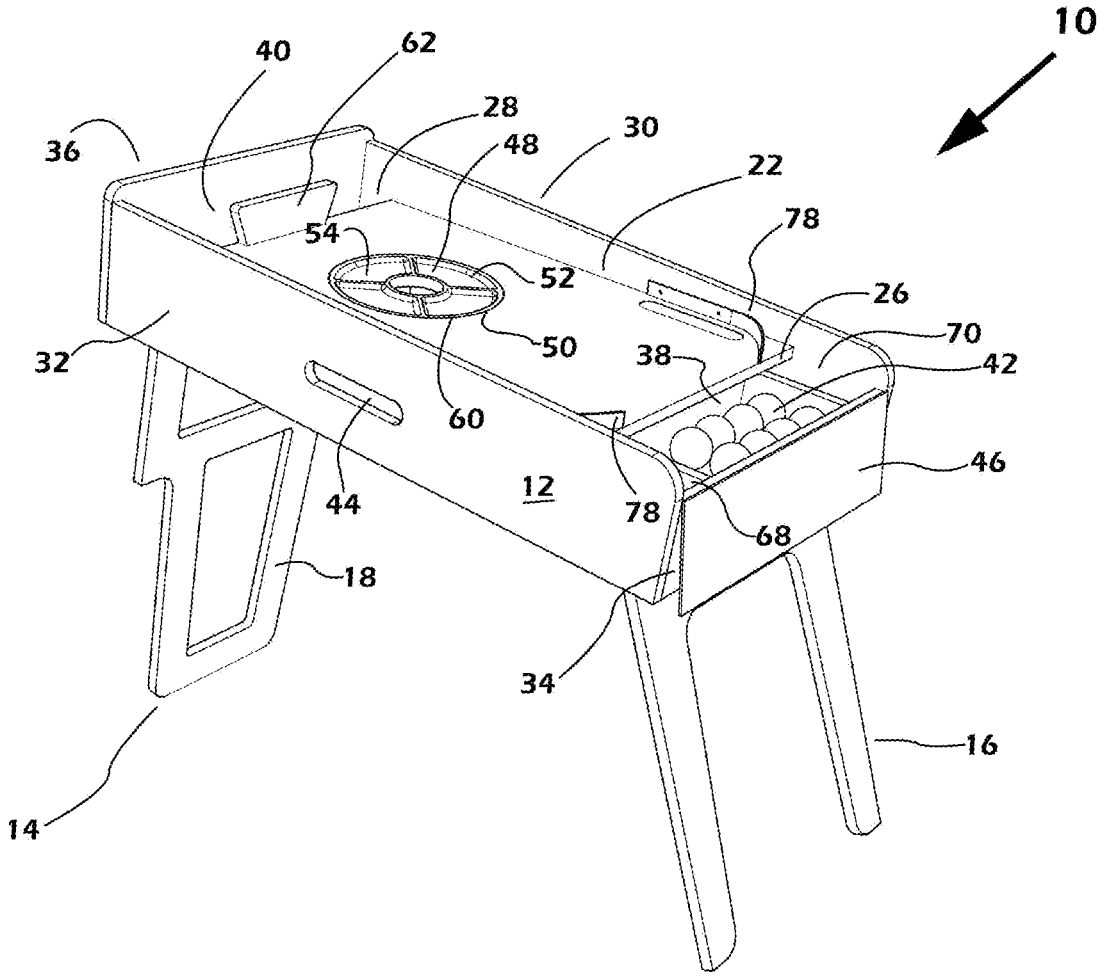
FIG. 1 is a perspective view of a projectile toss target game apparatus, in one exemplary embodiment.

FIG. 1 shows an illustrative embodiment of a projectile toss target game apparatus having a body 12 disposed upon supports 14. In this example, the supports 14 comprise a front leg unit 16 and a rear leg unit 18, where the leg units 16, 18 are hingeably attached to the body 12 such that they are rotatable between an open position (FIG. 1) in which the leg units 16, 18 support the body 12 at a table height level (e.g., 30-45 inches) above the ground, or a stowed position (FIG. 3B) in which the leg units 16, 18 are retracted and folded against a base of the body 12 such that the apparatus 10 can be easily stored or moved.

The body 12 includes a playing surface 20 shaped, in this illustrative embodiment, as a rectangle have a right side edge 22, an opposing left side edge 24, a front edge 26, and a rear edge 28. As shown particularly in FIGS. 1-2, the right and left side edges 22, 24 have a first length and the front and rear edges 26, 28 have a second length where the first length is greater than the second length. In one example, the first length is about 45.5 inches and the second length is about 25.5 inches.

The body 12 further includes sidewalls extending at least partly around the playing surface 20. As shown, the body includes a right sidewall 30, a left sidewall 32, a front sidewall 34, and a rear sidewall 36. The right and left sidewalls 30, 32 are disposed at the right and left side edges 22, 24 of the playing surface 20, respectively, and extend in a vertical manner upwardly therefrom. The front and rear sidewalls 34 and 36 extend parallel to the front and rear edges 26, 28 of the playing surface 20, respectively. However, the front sidewall 34 is separated from the front edge 26 of the playing surface 20 by a front gap 38. Similarly, the rear sidewall 34 is separated from the rear edge 26 of the playing surface 20 by a rear gap 40. As will be discussed in detail herein, the front gap 38 is arranged to collect and store projectiles 42 and the rear gap 40 is arranged to collect overthrown projectiles 42 and to direct them to an area within the front gap 38.

The body 12 may also include a cover flap 46 moveably connected relative to the front gap 38 so as to enable selective covering or exposure of the gap 38. In the illustrative embodiment, the cover flap 46 is hingeably connected to the front sidewall 34 and may be pivoted into an open opposition (shown, e.g., in FIG. 1), in which areas within the front gap 38 may be accessed, and a closed position (shown, e.g., in FIG. 3A) in which the gap 36 is partly or fully occluded. The hinged nature of the cover flap 46 is illustrative. Alternatively, the cover flap 46 may slide into the closed position from a stowed disposition, for example, from beneath in the playing surface 20.

Figure 3A:
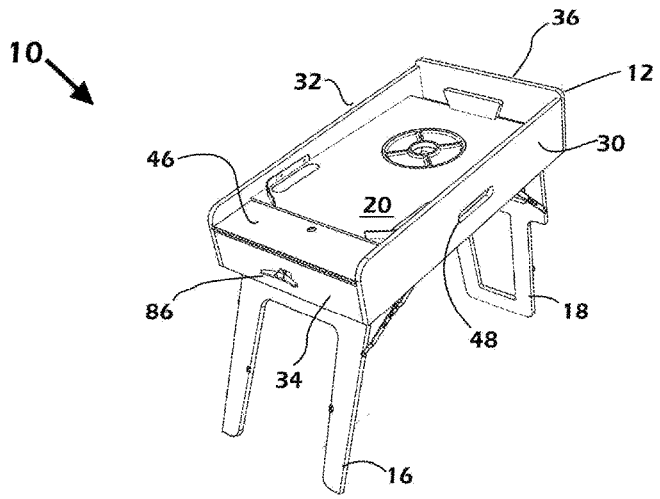
FIG. 3A is another perspective view thereof with a cover flap in a closed position.
Figure 3B:
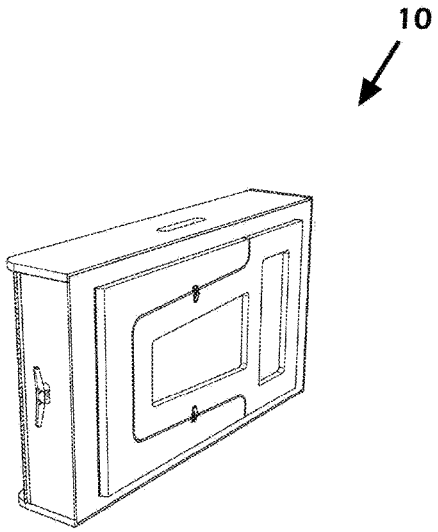
FIG. 3B is a view of the game apparatus in a stowed position.

One or more of the sidewalls 32-38 may include a handle to facilitate moving the apparatus 10 when in the stowed position of FIG. 3B. For example, a handle cutout 44 is shown in FIG. 1 at the left sidewall 34.

Figure 3C:
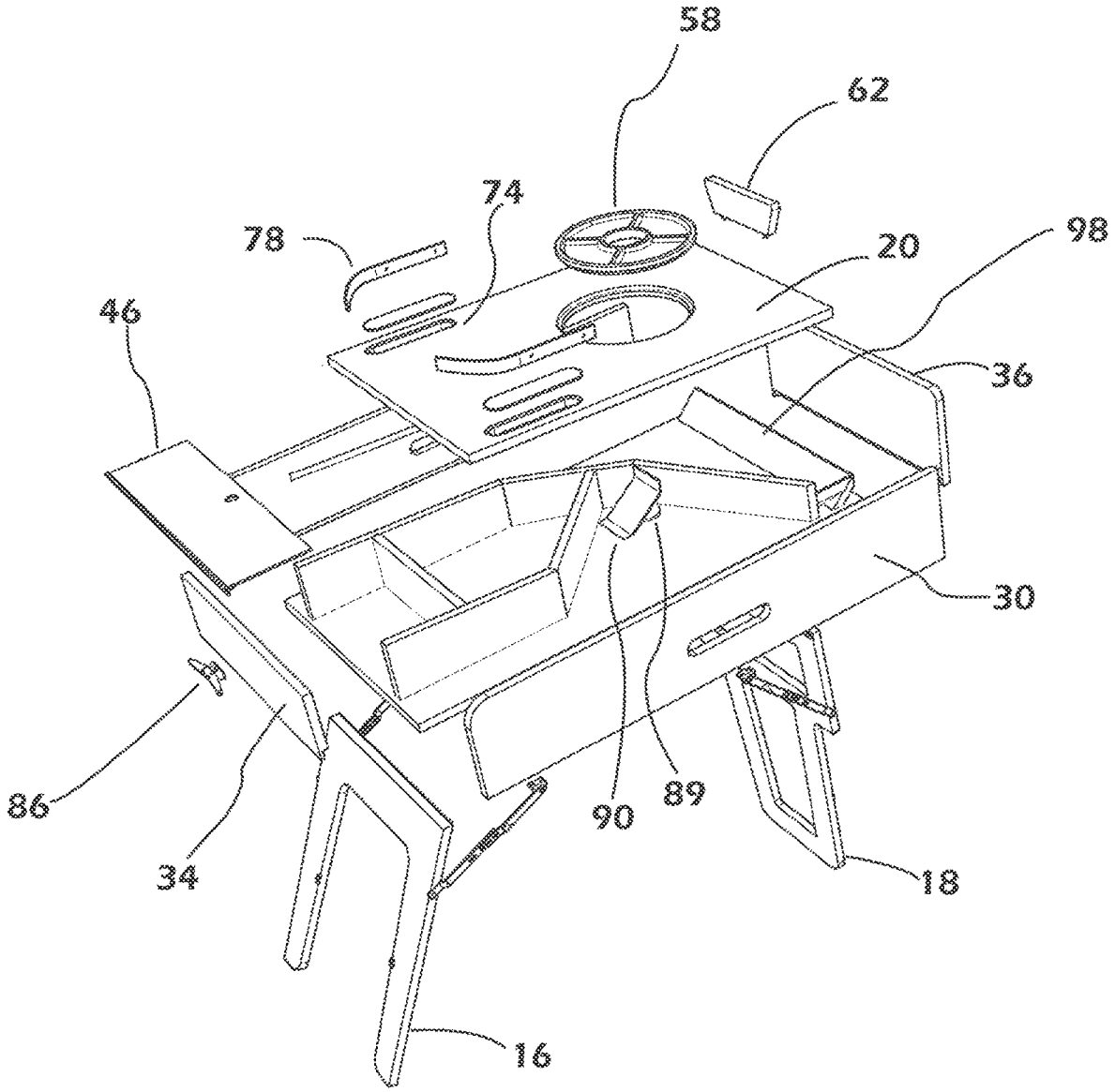
FIG. 3C is an exploded view thereof.
Figure 3D:
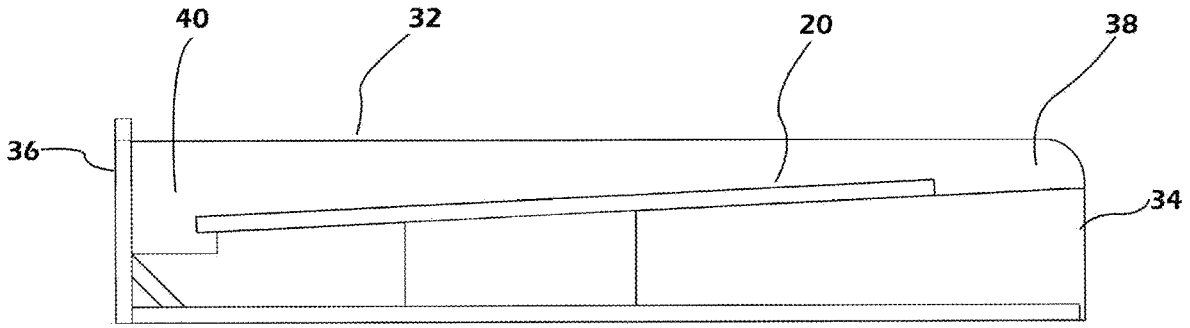
FIG. 3D is a sectional side view thereof.

The right, left, front, and rear sidewalls 30-36 form exterior walls of the body 12 of the game apparatus 10. The right, left and rear sidewalls 30, 32, 36 extend along an entirety of the right, left, and rear side edges 22, 24, 28 of the playing surface 20, respectively, and extend generally vertically to a height above the playing surface 20. In the illustrated example, the height of the right and left side walls 30, 32 above the playing surface increases from the front edge 26 to the rear edge 28 such that the right and left side walls 30, 32 are higher near the rear gap 40 than near the front gap 38. The height of the rear side wall 36 relative to the playing surface 20 is similar to the height of the right and left sidewalls 30, 32 near the rear edge 28. In this embodiment, the playing surface 20 slopes downwardly from the front sidewall 34 towards the rear side wall 36. See, FIG. 3D. However, in this embodiment, the rear leg unit 18 is longer than the front leg unit 16 such that when the game apparatus 10 is in the open configuration of FIG. 1, the playing surface 20 slopes downwardly toward the front wall 34 relative to the ground.

In alternative embodiments, the game apparatus 10 may include any of the following: the right, left, and rear sidewalls 30, 32, 36 having the same height; the playing surface may be arranged perpendicular to the front and rear sidewalls, 34, 36; the leg units 16, 18 being of equal height; the right, left, and rear sidewalls 30, 32, 36 having variable height across their length with a linear and/or curvilinear profile.

The angle of the playing surface 20 relative to ground can be varied to increase or decrease the level of difficulty of the game apparatus 10. In a normal competitive position, the playing surface 20 is at an angle relative to the ground of about 6.5 degrees. In an easier playing position, the playing surface 20 is at an angle relative to the ground of about 5 degrees. In a more difficult position, the playing surface 20 is at an angle relative to the ground of about 8 degrees. The angle of the playing surface 20 may be varied by adjusting the length of the front and/or rear leg units 16, 18. Alternatively, the apparatus 10 may include an internal pivoting mechanism which a user can operate mechanically or electronically in order to alter the pitch of the playing surface 20.

The playing surface 20 includes an opening 48 formed therethrough and a recessed area 50 formed proximate to the opening 48. As shown in the drawings, the exemplary opening 48 is circular and is disposed along a central longitudinal line Y-Y and slightly rearward of a central latitudinal line X-X. See, FIG. 2. The opening 48 is of sufficient size to allow passage of a projectile 42 into an area beneath the playing surface 20. For example, a diameter of the opening 48 may be about 3.6 inches.

The recessed area 50 is a region adjacent to the opening 48 that is configured to receive and retain the projectiles 42 on the sloped playing surface 20 and to prevent the projectiles 42 from rolling downward toward the front edge 26. In one exemplary embodiment, the recessed area 50 comprises a plurality of arcuate shaped indented compartments 52 extending in a concentric manner around the opening 48 and divided by a plurality of raised surfaces 54. The raised surfaces 54 are coplanar with the playing surface 20 and the indented compartments 52 each have a base 56 which extends between the respective raised surfaces 54 and between the opening 48 and an outer circumference of the recessed area 50. Each base 56 is parallel to and non-coplanar with the playing surface 20. That is, the base 56 of each indented compartment 52 is set into or disposed beneath the playing surface 20. For example the indented compartments 52 may have a depth of about 0.3-0.6 inches relative to the playing surface 20 and preferably about 0.31 inches. In the illustrated example, the plurality of arcuate shaped indented compartments 52 comprise four equivalently sized and shaped compartments 52, each of these compartments 52 bounded by two of the raised surfaces 54, where all of the raised surfaces 54 extend radially from the opening 48 to the outer circumference of the recessed area. An additional raised surface 54 extends around the opening 48 such that the indented compartments 52 are bounded by the raised surfaces 54 on all sides. The radially extending raised surfaces 54 are arranged at an angle to both the longitudinal and latitudinal lines Y-Y and X-X. In an alternative arrangement, the radially extending raised surfaces 54 may be arranged parallel to both the longitudinal and latitudinal lines Y-Y and X-X. The raised surfaces 54 extend perpendicularly upward from the bases 56 of the indented compartments 52, or the raised surfaces 54 may extend in a curved manner from the bases 56 of the indented compartments 52 (for example, with a radius of curvature of 5/16 inches), or any various combination or variation thereof. The raised surfaces 54 have a thickness in the circumferential direction of about 0.25 inches, and extend radially about 3-4 inches from the opening 48 to the outer circumference of the recessed area 50. The indented compartments 52 correspondingly have a radial dimension of about 3-4 inches.

Figure 4A:
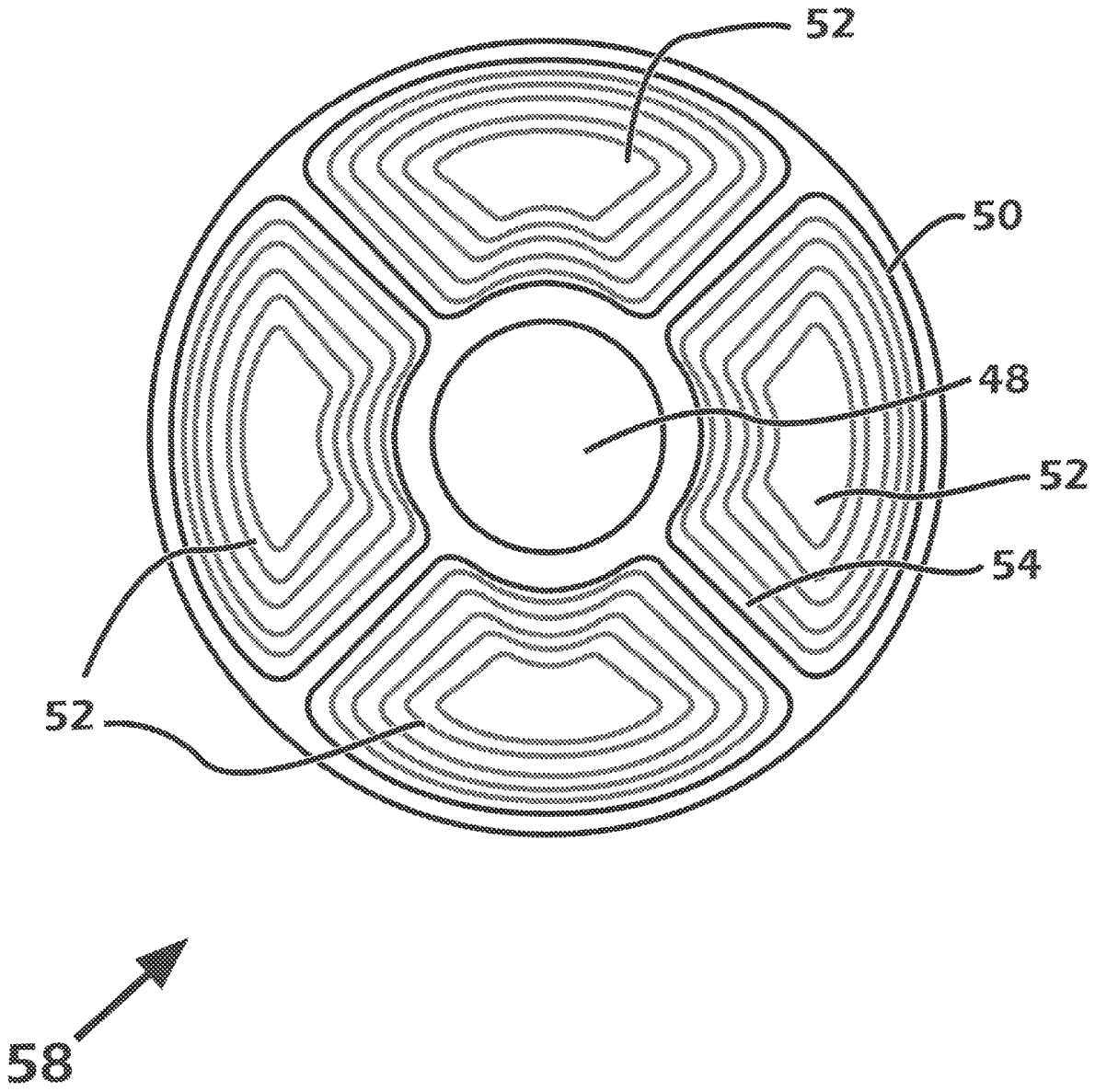
FIG. 4A is a top view of a disc shaped element which is insertable into a playing surface of the game apparatus.
Figure 4B:
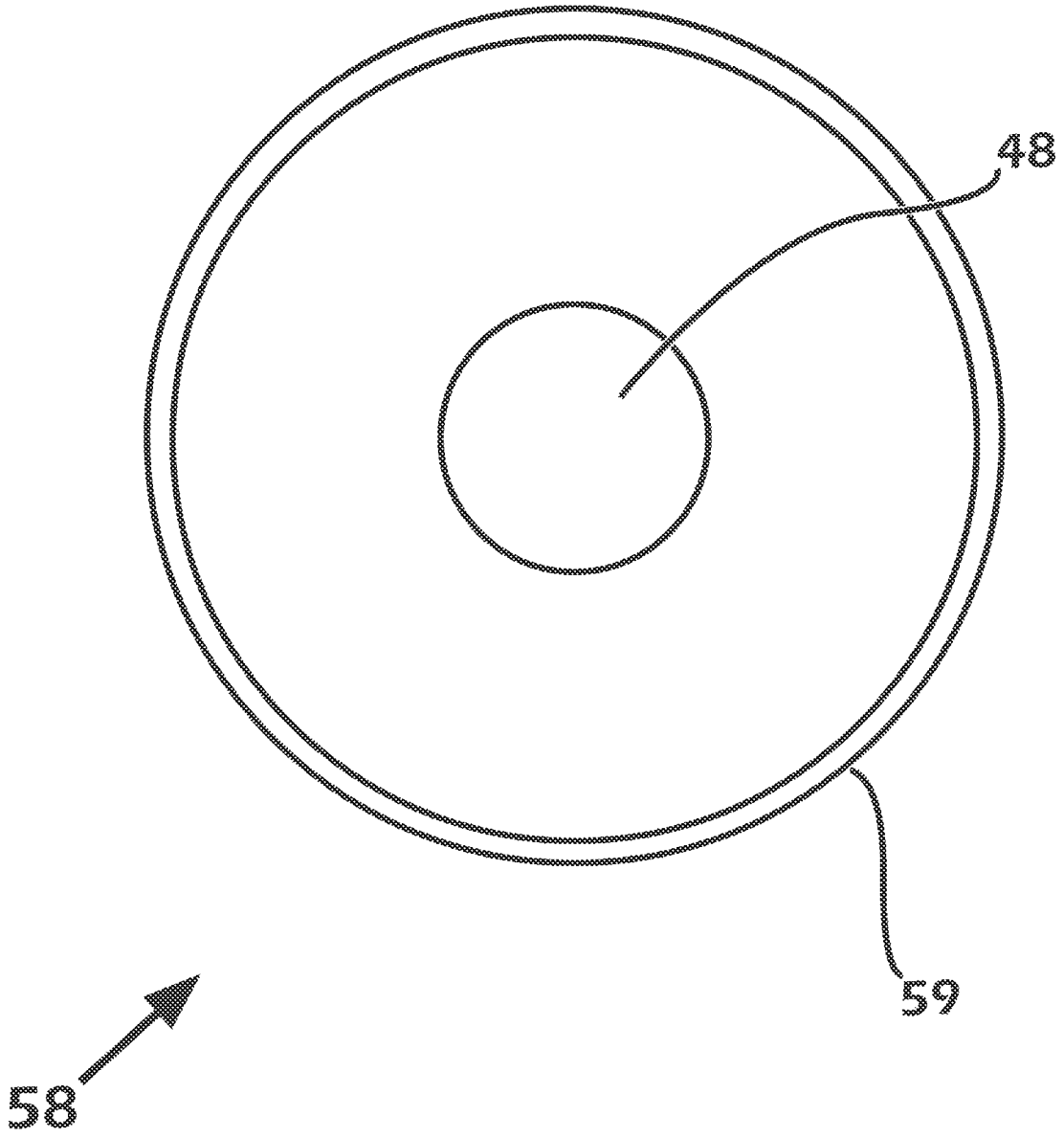
FIG. 4B is a bottom view thereof.
Figure 4C:
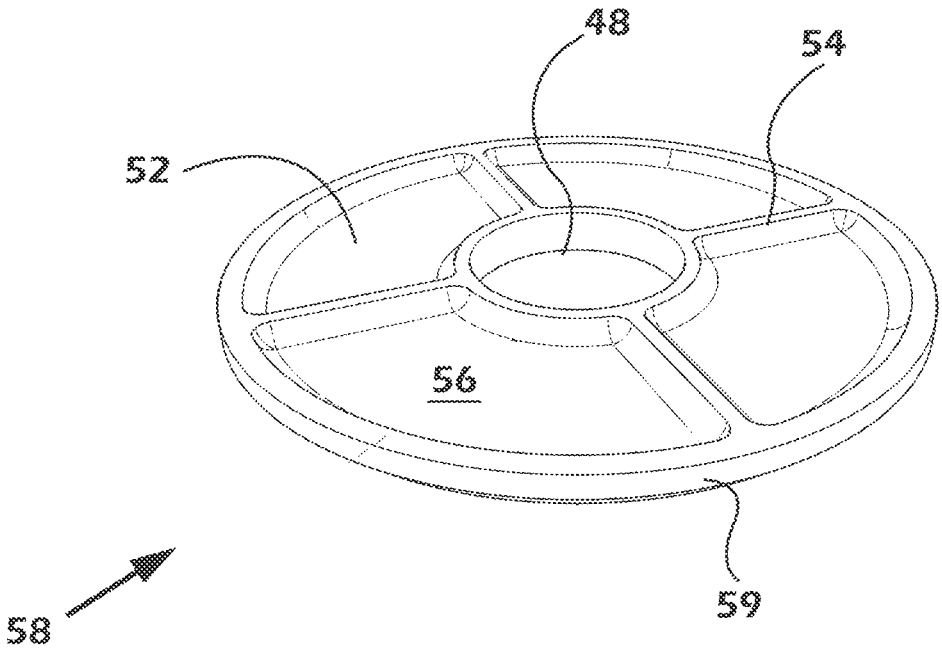
FIG. 4C is a perspective view thereof.

In the illustrated embodiment, the opening 48 and recessed area 50 are comprised within a disc shaped element 58 (see, e.g., FIGS. 4A-4D) that is removably disposed in an aperture 60 formed with in the playing surface 20. The aperture 60 may include a ledge 61 upon which the disc shaped element 58 sits when installed in the playing surface 20 and/or the disc shaped element 58 may include one or more mounting flanges to facilitate disposition on or within the playing surface 20. In the illustrated example of FIGS. 4A-C, the disc shaped element 58 includes a mounting flange 59 which extends around a circumference of the element 58 and is disposed to engage the ledge 61 of the playing surface 20 when the element 58 is mounted therein. The mounting flange 59 may extend about 0.3-0.5 inches in the radial direction. The ledge 61 may have a similar dimension such that the mounting flange 59 sits upon the ledge 61 when the disc shaped element 58 is disposed in the aperture 60 of the playing surface 20. The disc shaped element 20 can be made of wood, fiber board, plastic, vinyl, metal, ceramic, or any other suitable material. The disc shaped element 58 may include customized graphics, photographs, pictures, images, letters, numbers, characters, emojis, words, logos, and/or colors, as desired.

Figure 6A:
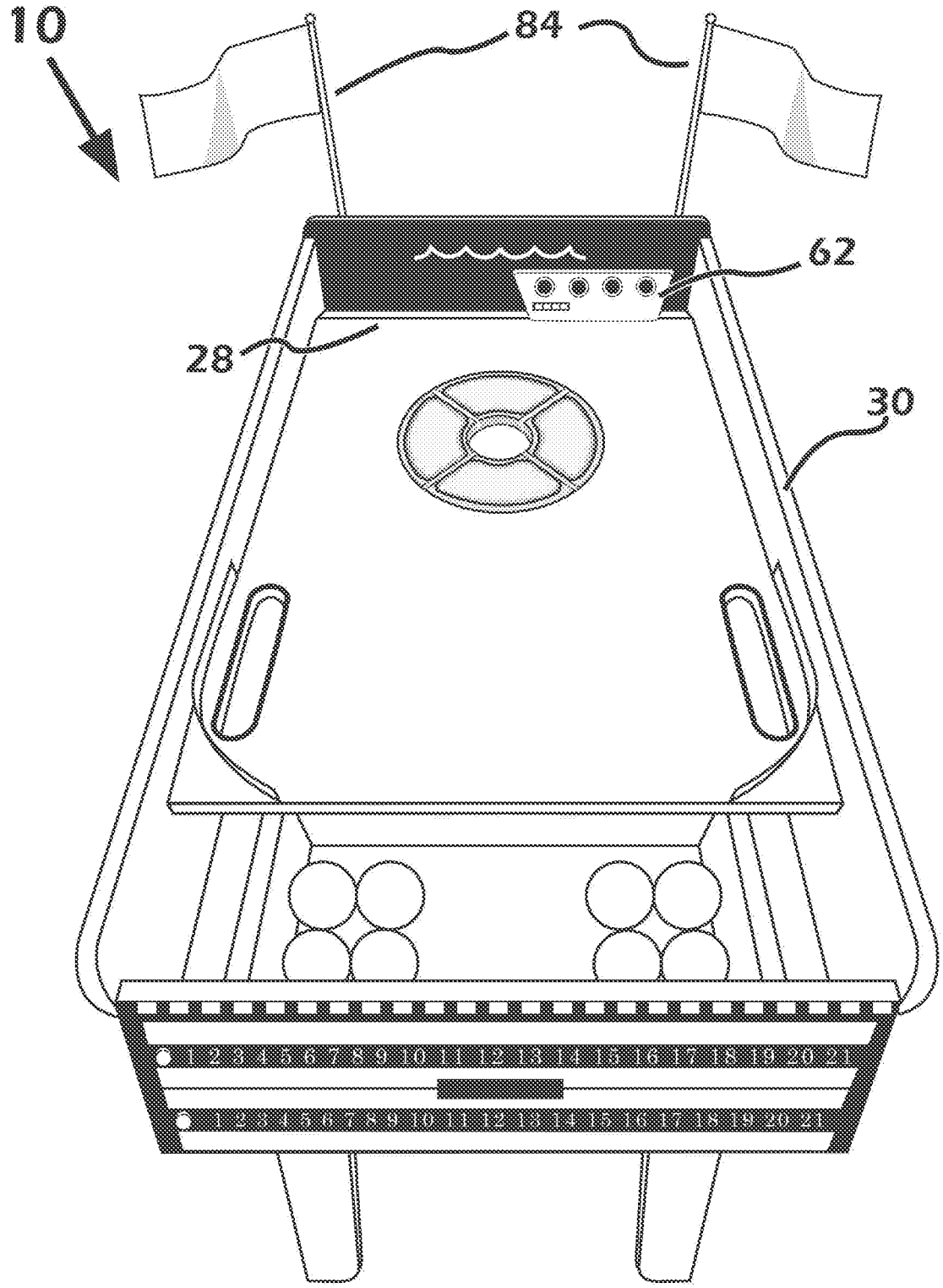
FIG. 6A-6C show the game apparatus of FIG. 1 with the blocking member in various positions.
Figure 6B:
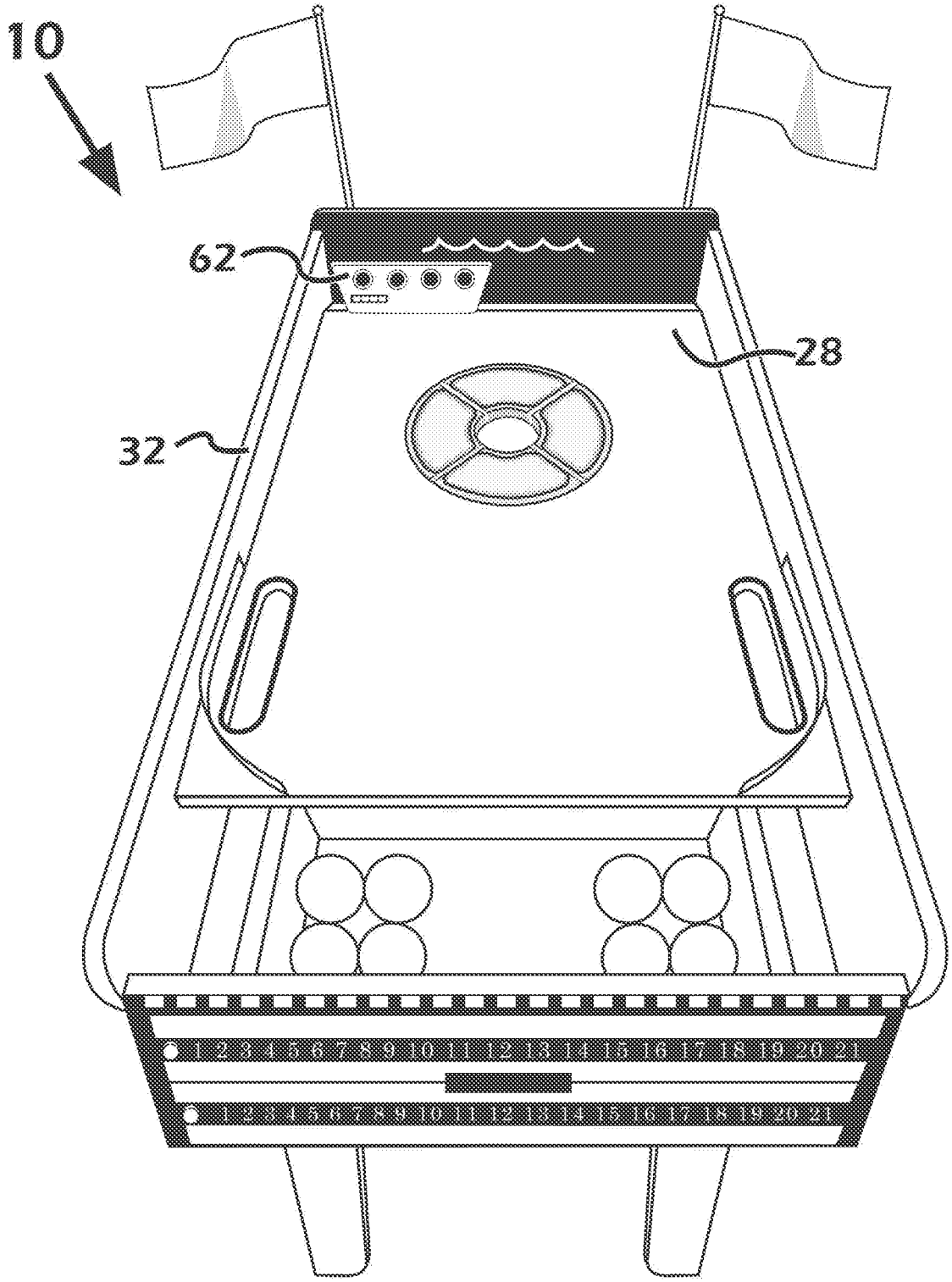
Figure 6C:
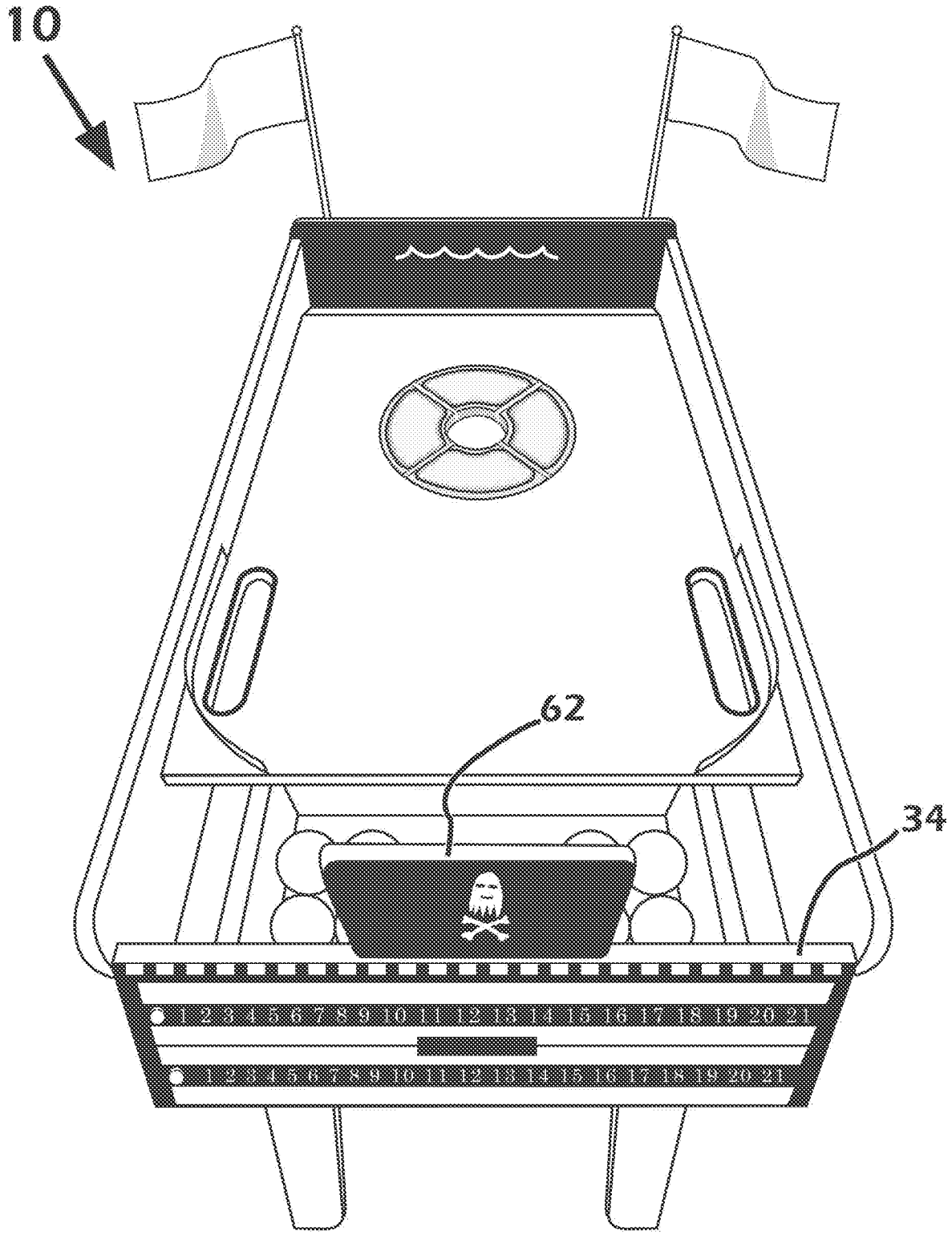

The game apparatus 10 further includes a blocking member 62 removably disposed on the playing surface 20 proximate to the rear edge 28. FIGS. 1-2, 5A-5B, and 6A-6D. In an exemplary embodiment, the blocking member 62 is an elongated planar member that extends generally vertically from the playing surface 20 when mounted thereupon and has one or more mounting pegs 64 extending downwardly from a bottom surface thereof. The playing surface 20 includes a plurality of mounting holes 66 which receive the mounting pegs 64 in order to allow disposition of the blocking member 62 at different positions along the rear edge 28. For example, in FIGS. 1-2, the blocking member 62 is positioned centrally at the rear edge 28 of the playing surface. FIGS. 6A-6B show the blocking member 62 positioned near the right side wall 30 and the left side wall 32, respectively. FIG. 6C shows the blocking member 62 in an alternate position on the front sidewall 34 which, in this embodiment, includes mounting holes 66. The blocking member 62 extends upwardly to a sufficient height when installed at the rear edge 28 of the playing surface 20 so as to prevent passage of an over tossed projectile 42 into the rear gap 40 and to redirect a path of the projectile 42, for example, back toward the opening 48.

The blocking member 62 may have a rectilinear and/or curvilinear profile. In the illustrated example (see particularly, FIGS. 5A-5B), the blocking member 62 is trapezoidal in shape having a height of about 2.88 inches, a bottom width of about 7 inches, and a top width of about 8 inches. The exemplary blocking member 62 is a planar member having a width of about 0.75 inches. The blocking member 62 may include customized graphics, photographs, pictures, images, letters, numbers, characters, emojis, words, logos, and/or colors, as desired.

Figure 6D:
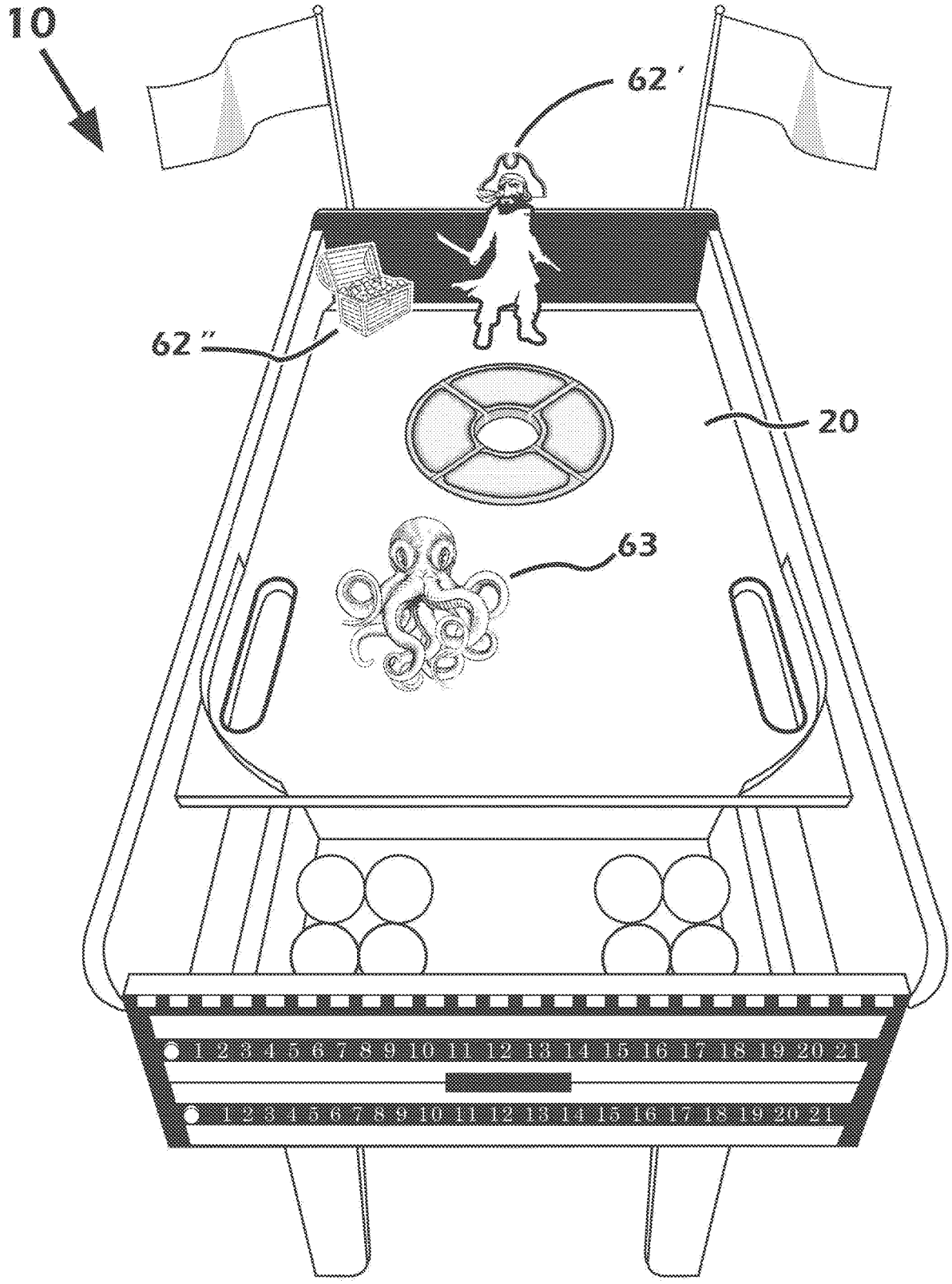
FIG. 6D is another view thereof having multiple blocking members and a blocking object disposed on a playing surface of the game apparatus.

In an alternate embodiment, as in FIG. 6D, the game apparatus 10 may include a plurality of blocking members 62' and 62" having different, non-trapezoidal shapes. The apparatus 10 may further include one or more additional blocking objects 63 arranged on the playing surface 20 to interfere with and redirect a projectile 42 tossed thereupon. These blocking members 62', 62" and blocking objects 63 may assume any desired shape and may, as illustrated, take the form of characters, animals, objects, etc.

Figure 2:
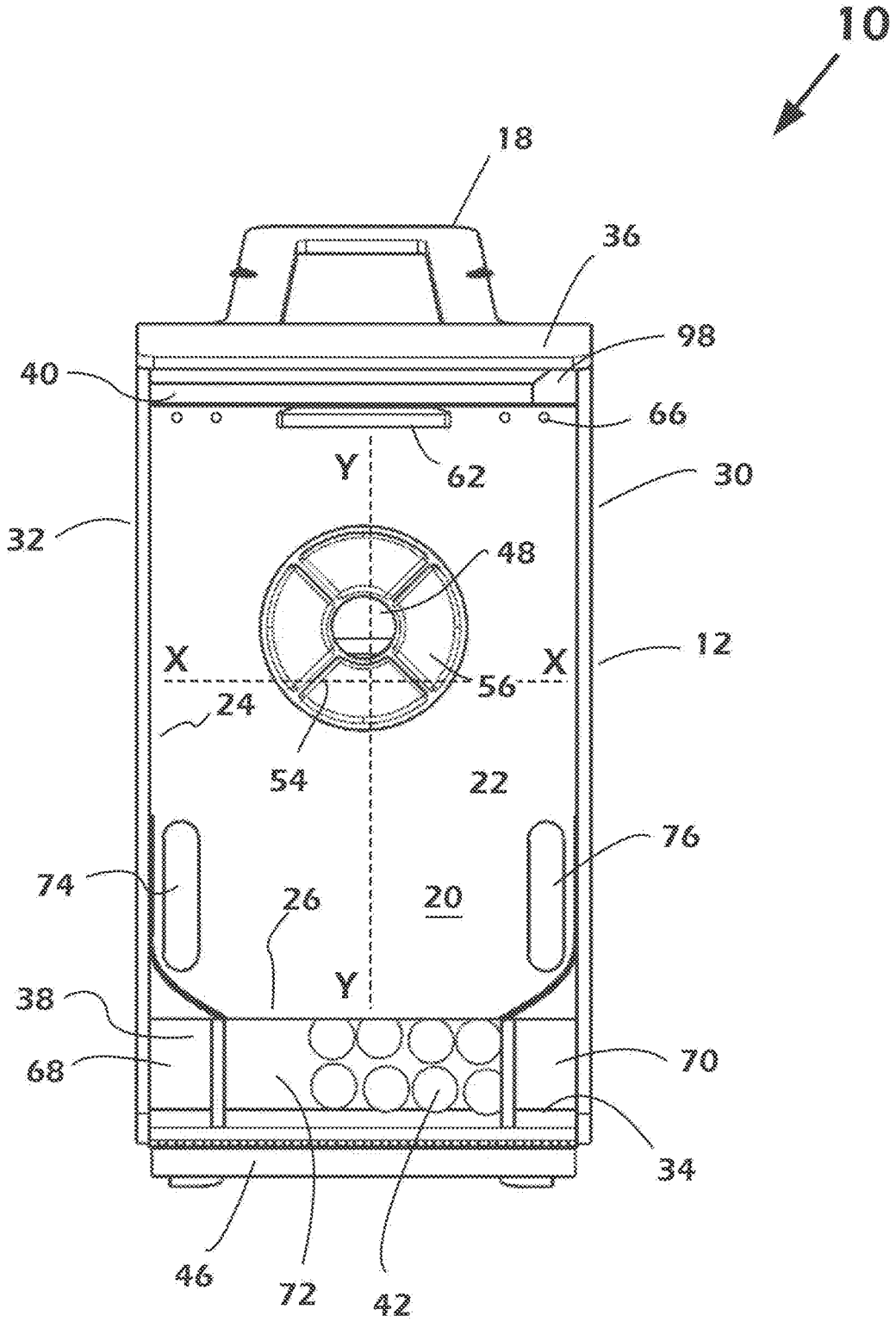
FIG. 2 is a top view thereof.
Figure 4D:
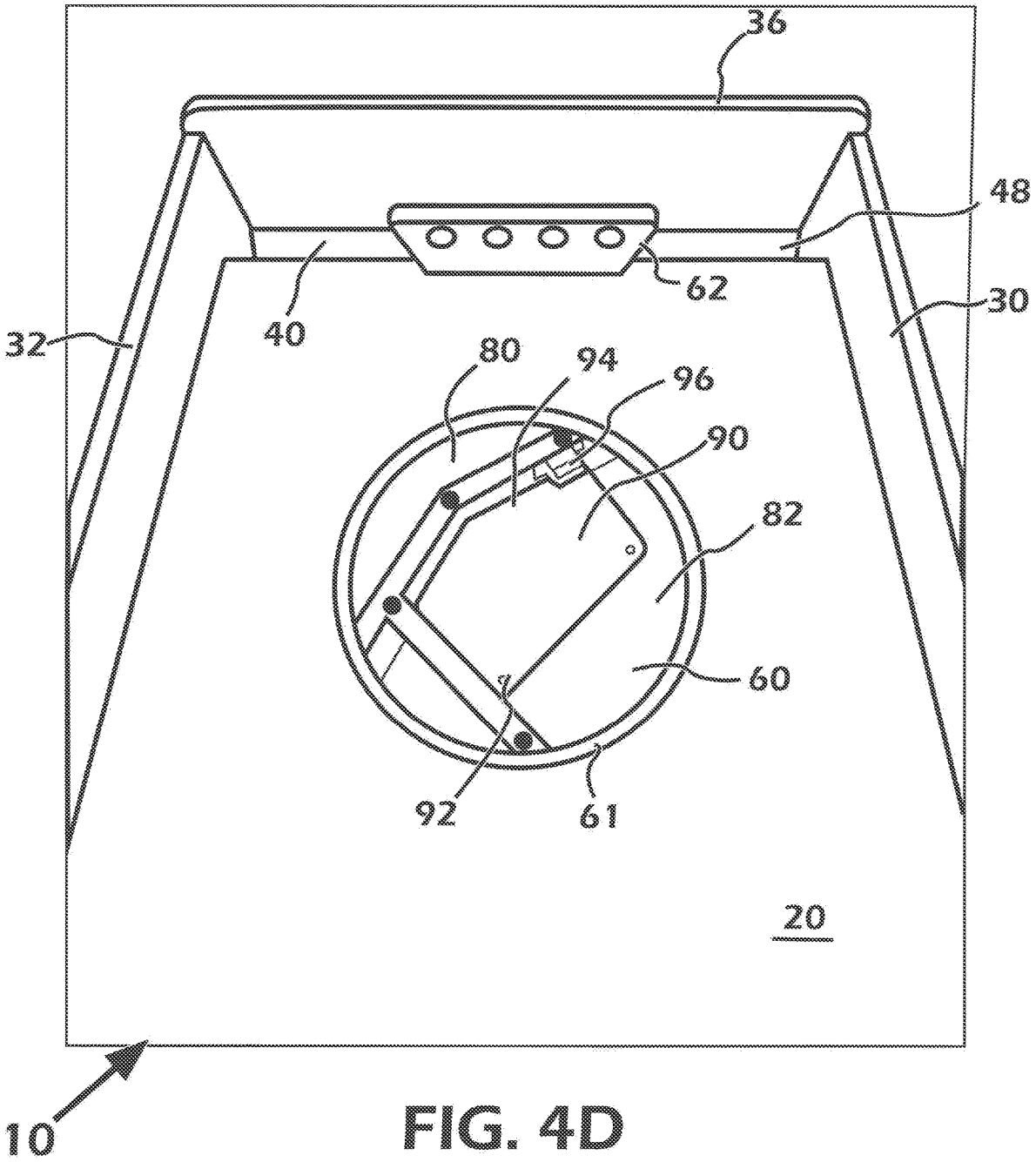
FIG. 4D is an enlarged view of the game apparatus of FIG. 1 with the disc shaped element removed.
Figure 5A:
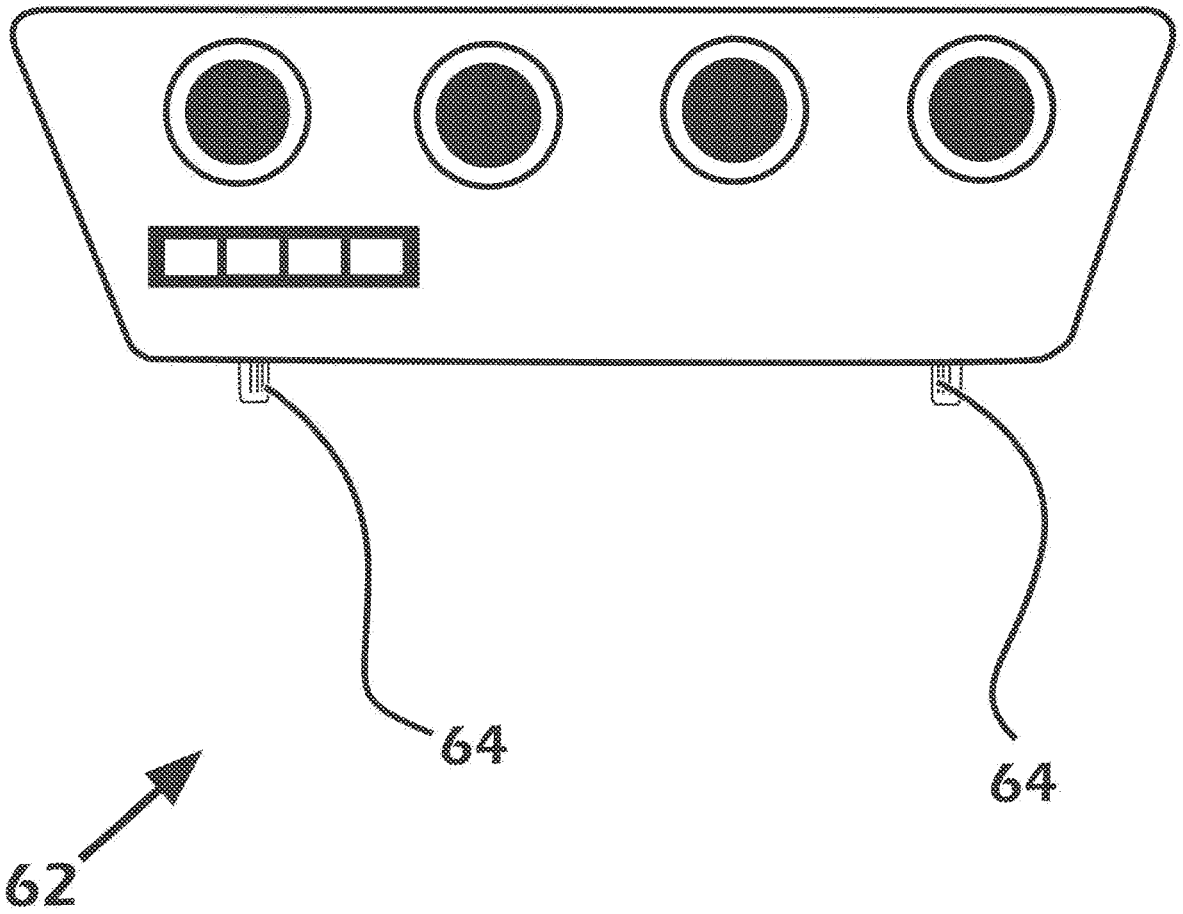
FIG. 5A is a front view of a blocking member of the game apparatus of FIG. 1.
Figure 5B:
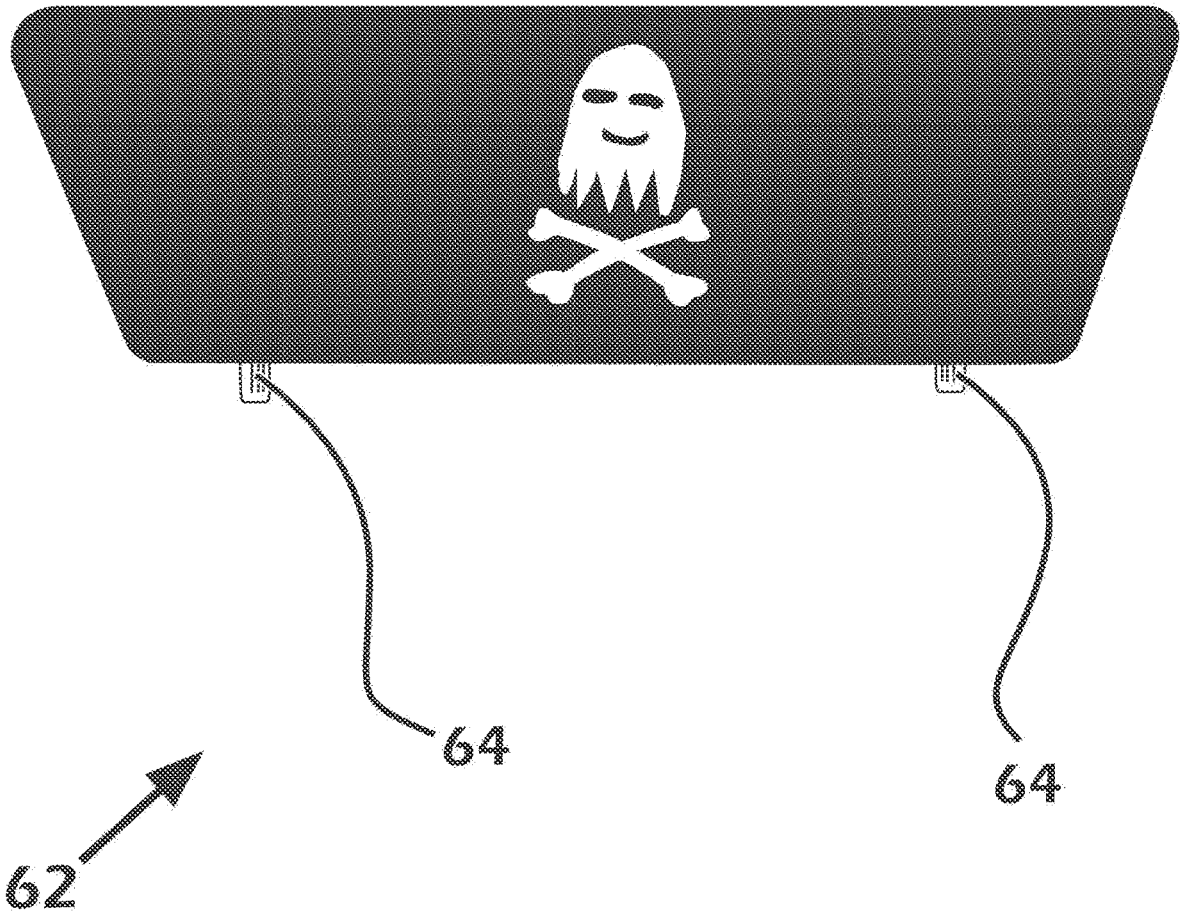
FIG. 5B is a rear view thereof.
Figure 7:
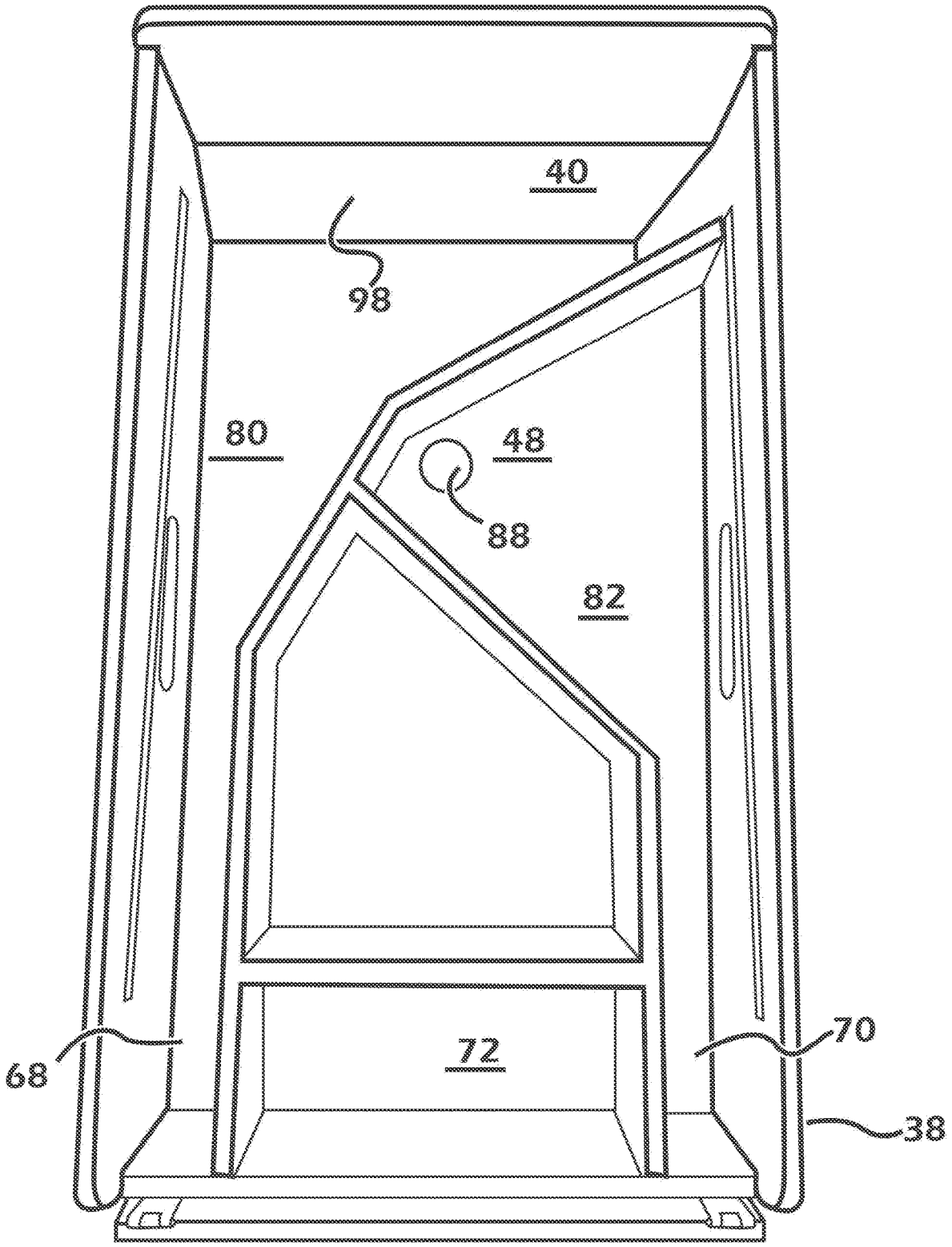
FIG. 7 is a top view of the game apparatus with a playing surface removed.

Referring again to FIGS. 1-2, the rear gap 40 extends longitudinally from the rear edge 28 of the playing surface to the rear sidewall 36 and latitudinally from the right sidewall 30 to the left side wall 32. The longitudinal dimension of the rear gap 40 is sufficient to allow passage in the gap 40 of an over tossed projectile 42. For example, the rear gap has a length in the Y-Y direction of about five inches. A first path exists beneath the playing surface 20 from the rear gap 40 to the front gap 38. With particular reference to FIGS. 2, 4D and 7, a first conduit 80 extends from an area at the rear gap 40 to a locker collection area 68 at the front gap 38 such that an over tossed projectile 42 that enters the rear gap 40 is directed to the locker collection area 68. Similarly, a second path exists beneath the playing surface 20 from the opening 48 to the front gap 38. Particularly, a second conduit 82 extends from an area at the opening 48 to a cove collection area 70 at the front gap 38 such that a projectile 42 that enters the opening 48 is directed to the cove collection area 70. The front gap 38 further includes a trench collection area 72 between the locker and cove collection areas 68, 70. The trench collection area is not in communication with either the first or second conduits 80, 82 and instead serves to receive projectiles 42 that do not enter the rear gap 40 nor the opening 48, but instead roll downward upon the playing surface 20 toward the front edge 26. A miter 98 is provided in the rear gap 40 proximate to the rear sidewall 36. The miter 98 comprises an angled surface that directs a projectile 42, which enters the gap 40, toward the first conduit 80.

The playing surface 20 further includes first and second viewing panes 74, 76 formed proximate to the locker and cover collection areas 68, 70, respectively. See, e.g., FIG. 2. The first viewing pane 74 is arranged to allow projectiles 42 disposed in the locker collection area 68 to be visible to a player. Similarly, the second viewing pane 76 is arranged to allow projectiles 42 disposed in the cover collection area 68 to be visible to the player. In the illustrated example, the viewing panes 74, 76 are elongated transparent elements (glass, plastic, etc.) set into the playing surface 20 to allow the described visibility but to not effect movement of the projectiles 42 thereupon.

The playing surface 20 further includes directing elements 78 which are arranged to direct projectiles 42 that do not enter the rear gap 40 nor the opening 48, but instead roll downward toward the front edge 26. In the exemplary embodiment, the directing elements 78 are members which extend upwardly from the playing surface 20 and which curve from the right and left sidewalls 30, 32 to the front edge 26. The directing members 78 essentially block the locker and cove collecting areas 68, 70 from a projectile 42 descending on the playing surface and redirect such descending projectile 42 toward and into the trench collection area 72.

FIGS. 6A-6C illustrate the game apparatus 10 as including flags 84 removably mounted at the rear sidewall 36. These flags can have different colors, graphics, images, text, numbers, etc., and may be used to represent opposing players and/or teams.

Figure 8:
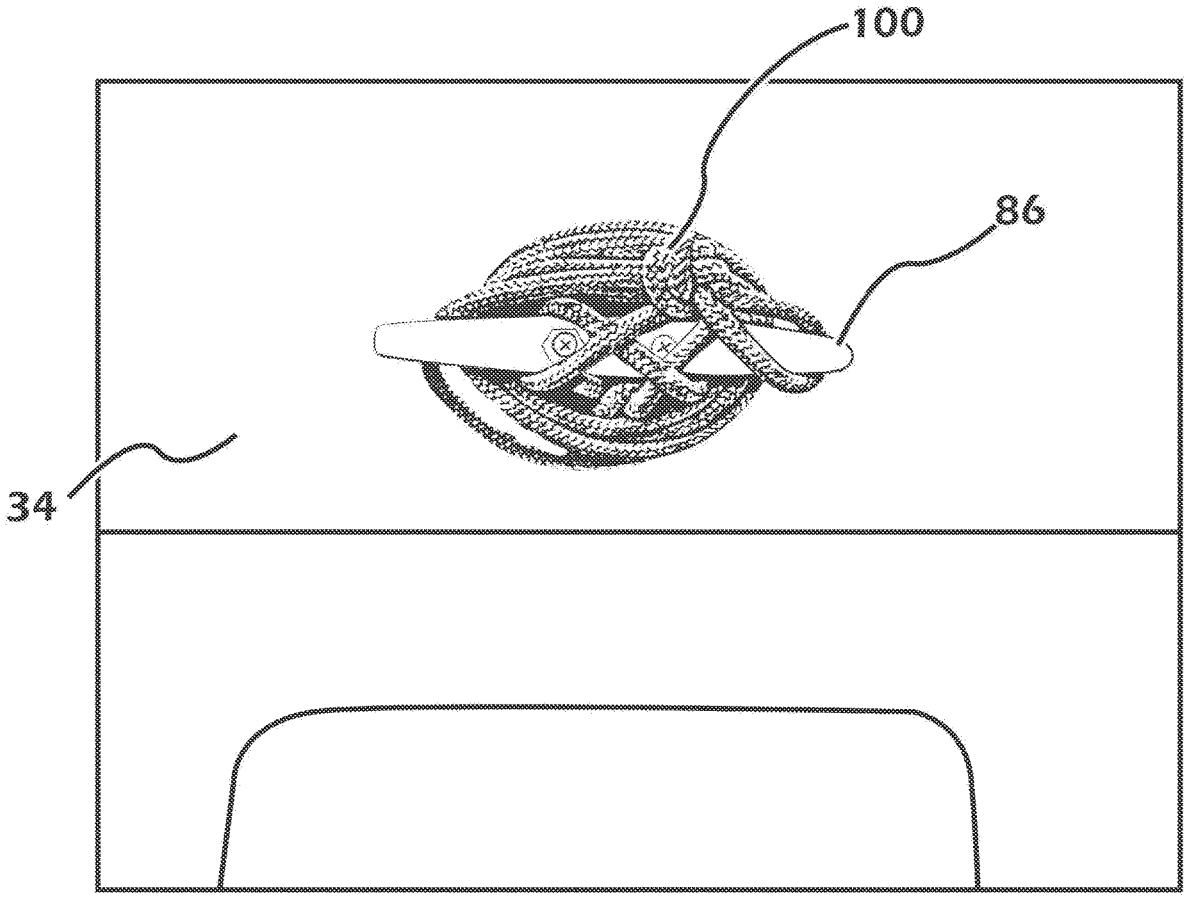
FIG. 8 is an enlarged front view of the game apparatus of FIG. 1 showing a cleat and a cord wrapped therearound.

FIG. 8 shows an enlarged view of the game apparatus 10 of FIG. 3A with the over flap 46 in the closed position covering the locker, cove, and trench collection areas 68, 70, 72. With the flap 46 in this position, a cleat 86 is revealed on the exterior of the front sidewall 34. A cord or rope 100 of a predetermined length is fastened to the cleat 86 and wrapped thereabout for storage. The predetermined length is a length from which a player tosses the projectile 42 during game play. At the start of the game, the player unwinds the cord 100 and extends it from the cleat 86, in a direction perpendicular from the front sidewall 34, until taught. A mark may be placed on the floor at the extended location of the cord 100 to indicate the spot from which the projectile is to be tossed. The cord 100 is then wrapped again around the cleat 86 and play may begin.

The game apparatus 10 may further include an audible feature associated with the opening 48 such that a sound is produced when a projectile 42 passes through the opening. For example, an interior of the apparatus 10 may include a mounting area 88 for a bell 89 disposed in the area of the opening 48. See, FIGS. 3C, 4D and 7. A striking device 90 may be positioned over the mounting area 88 and may be further positioned such that a projectile 42 passing through the opening 48 will contact the striking device 90 which in turn will strike the bell 89 to emit a tone. The striking device 90 may be oriented to direct a projectile 42 passing through the opening 48 to enter and follow the second conduit 82 to the cove collection area 70. In the illustrated example, the striking member 90 is an angled member fixed to the game apparatus 10 at a lower edge 92 and releasably retained at an upper edge 94 by a magnet 96 so as to be suspended above the bell 89. When a projectile 42 descending through the opening 48 contacts the striking member 90, the retention force between the magnet 96 and the striking member 90 is overcome, and the striking member 90 pivots downwardly and strikes the bell 89 which produces the tone. The projectile 42 is then directed into the second conduit 82 and the force of the magnet 96 returns the striking member 90 to an engaged position against the magnet 96, once again suspended above the bell 89. Other sounding mechanisms are contemplated such as electrical. Also, similar audible features may be located in one or more of the rear gap 40 and the trench collection area 72.

The various features and details of the elements of the disclosed game apparatus are described herein by way of example. The broad scope of the invention contemplates many variations and alternatives.

The playing surface 20 may include one or more non-planar and/or curved regions, it may be shaped in a rectilinear, curvilinear, and/or abstract manner, and the playing surface may be disposed on or above the ground at any desired angle from 0-90 degrees. The opening 48 may have any desired size and shape sufficient to allow passage of the projectile 42 and may be disposed at any desired location upon the playing surface 20. The playing surface 20 may include multiple openings 48 of similar or different size and/or shape.

The recessed area 50 may be disposed on the playing surface 20 proximate to and in contact with the opening 48, as illustrated. Additionally and/or alternatively, the recessed area 50 may be disposed proximate to but not in contact with the opening 48. The recessed area 50 may be in a location distal from the opening 48. The playing surface 20 may include one recessed area 50 or a plurality of recessed areas 50. The recessed area 50 may be arcuate or circular in shape or rectilinear, curvilinear, or any variation or combination thereof. The recessed area 50 may include any number of the indented compartments 52, for example, four as illustrated, or one, two, three, or more than four. The indented compartments 52 are described as being inset into the playing surface 50 and as being bordered by the raised surfaces 54. Alternatively and/or additionally, the compartments 52 may be coplanar with the playing surface 50 and the raised surfaces 54 may extends upwardly above the playing surface in order to create one or more regions for receiving and retaining the projectiles 42 as discussed.

Figure 9A:
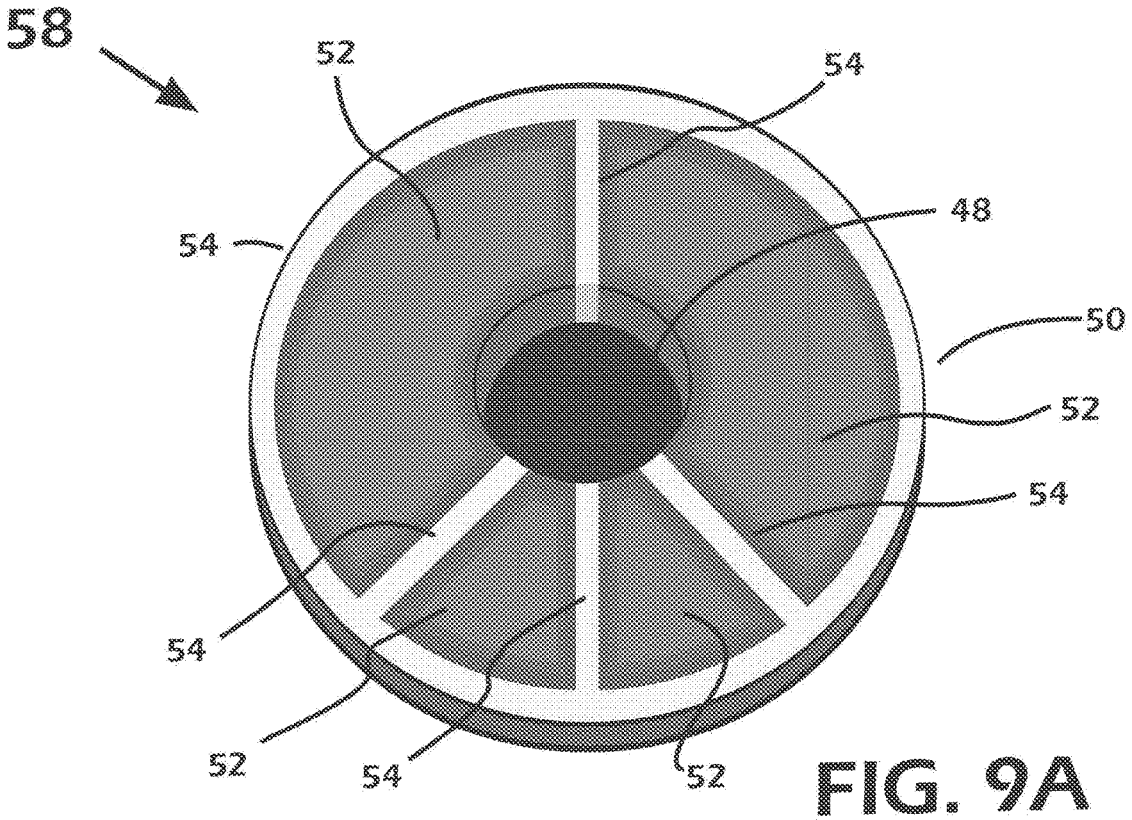
FIGS. 9A-9G show various alternate embodiments of the disc shaped element shown in FIG. 4A-4C.
Figure 9B:
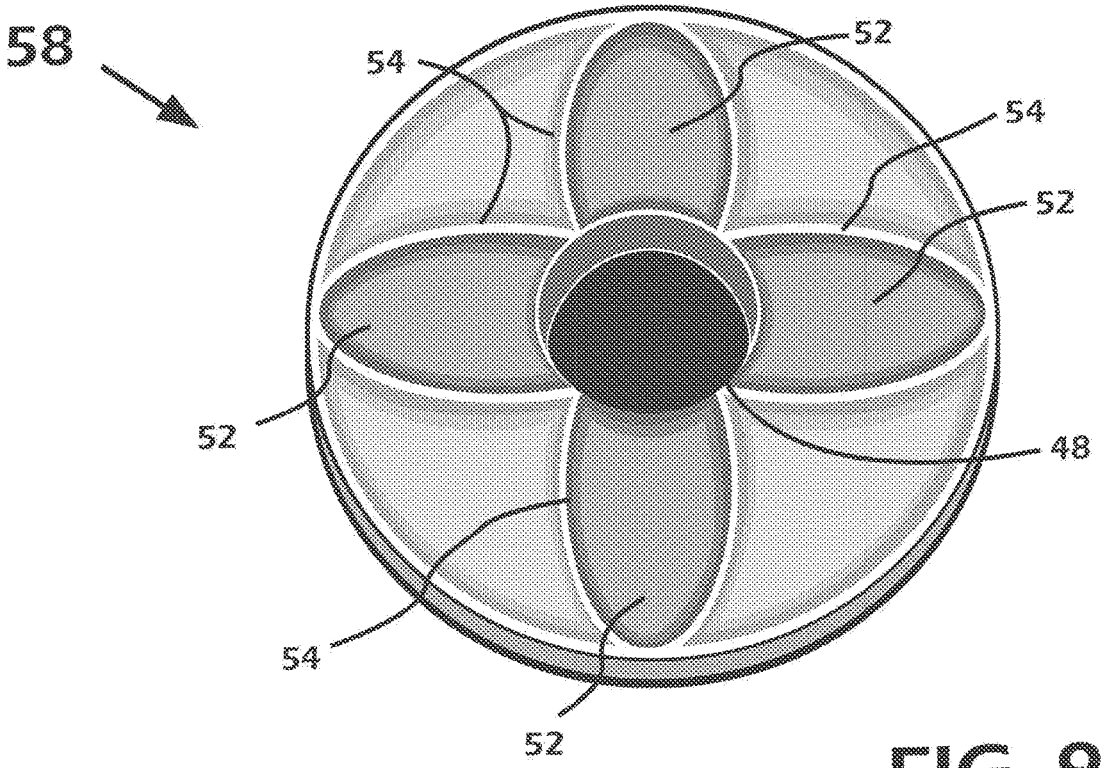
Figure 9C:
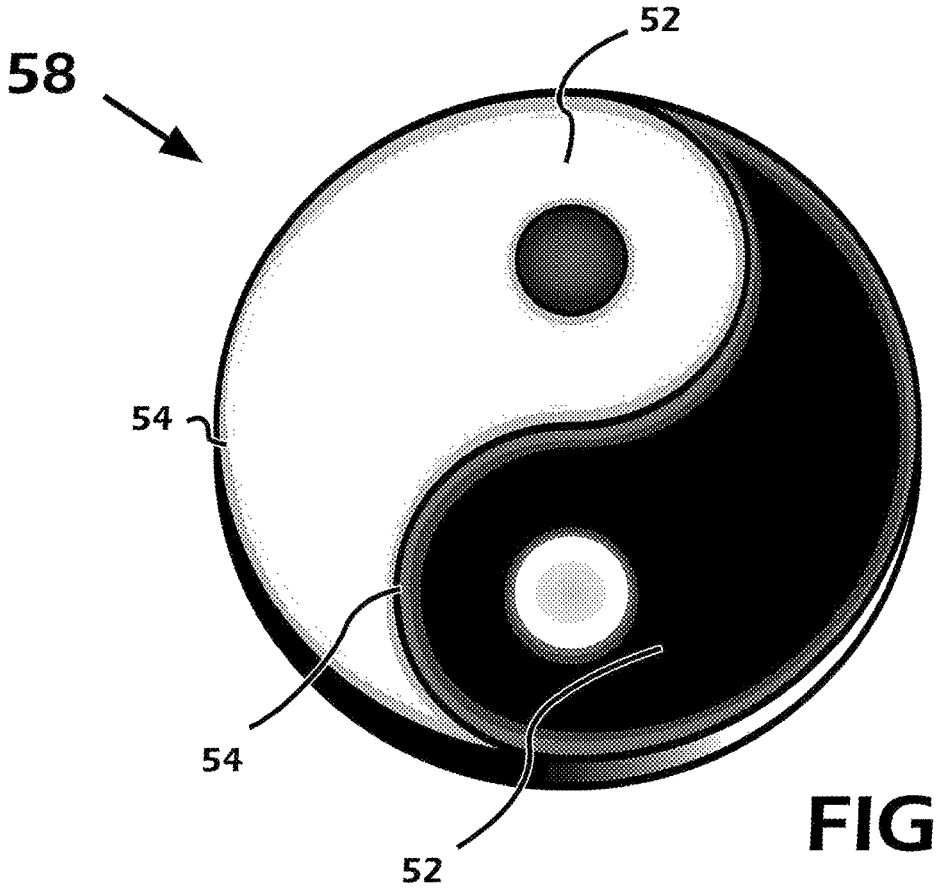
Figure 9D:
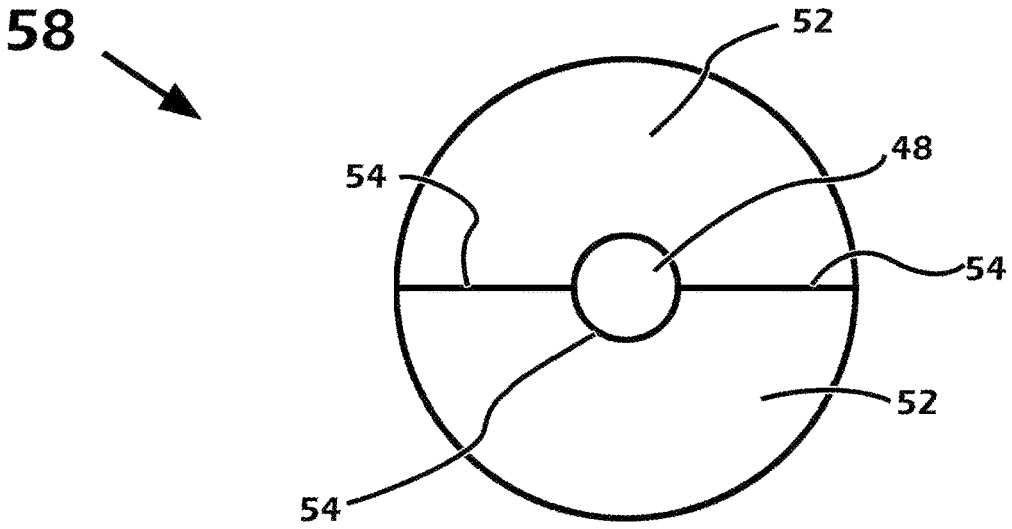
Figure 9E:
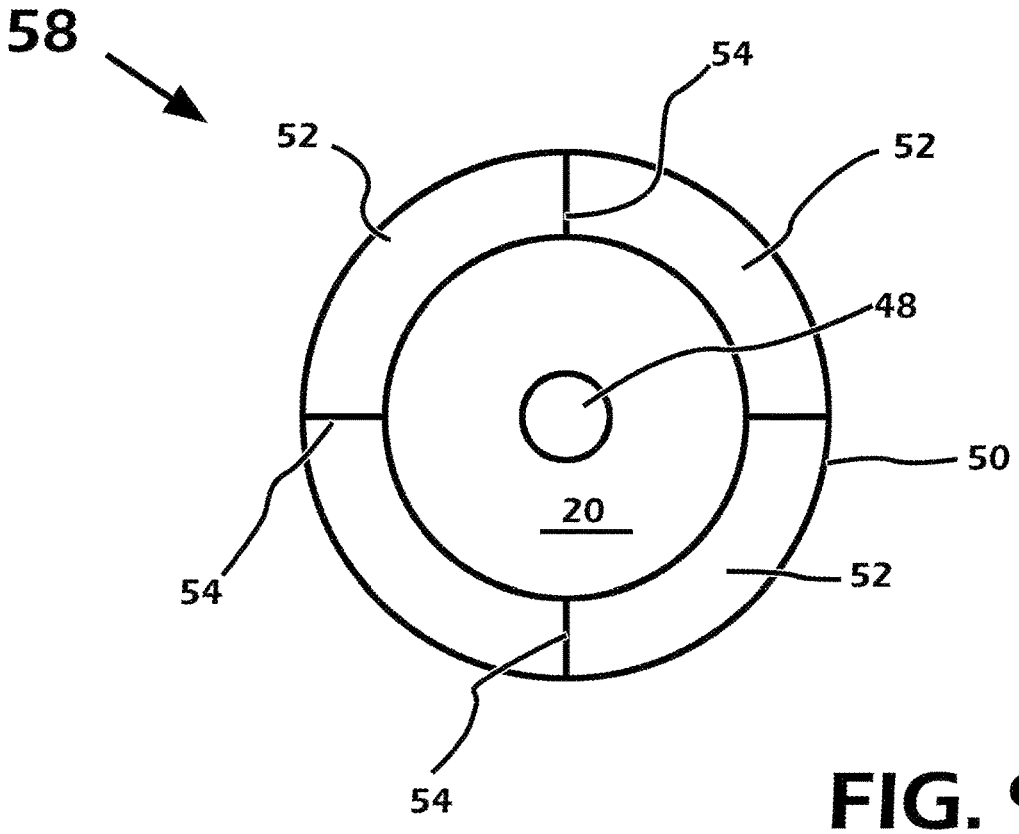

FIGS. 9A-9E show illustrative alternative embodiments of the disc shaped element 58. In FIG. 9A, the disc shaped element 58 includes four radially extending raised surfaces 54 delimiting two generally triangular shaped indented compartments 52 and two arcuate shaped indented compartments 52. FIG. 9A shows a disc shaped element 58 having four indented compartments 52 arranged in a flower-petal-like arrangement bordered by raised surfaces 54. These raised surface 54 may trace the petal-shaped indented compartments 54 thus delimiting further indented compartments 54 therebetween, and/or the indented surfaces 54 may extend fully or partly between adjacent petal-shaped compartments 52. FIG. 9C shows a disc shaped element 58 which omits the opening 48 and instead provides two indented compartments 52 having a 'yin' and 'yang' shape. Raised surfaces 54 extend around the circumference of the disc shaped element 58 and delimit the respective 'yin' and 'yang' shapes. The disc shaped element 58 of FIG. 9D is similar to that of FIGS. 4A-4C, but includes only two radially extending raised surfaces 54. FIG. 9E shows a central opening 48 surrounded by a circumferential recessed area 50 with the playing surface 20 extending therebetween. The circumferential recessed area 50 is divided into a plurality of arcuate shaped indented compartments 52 as in the disc shaped element of FIGS. 4A-4C.

Figure 9F:
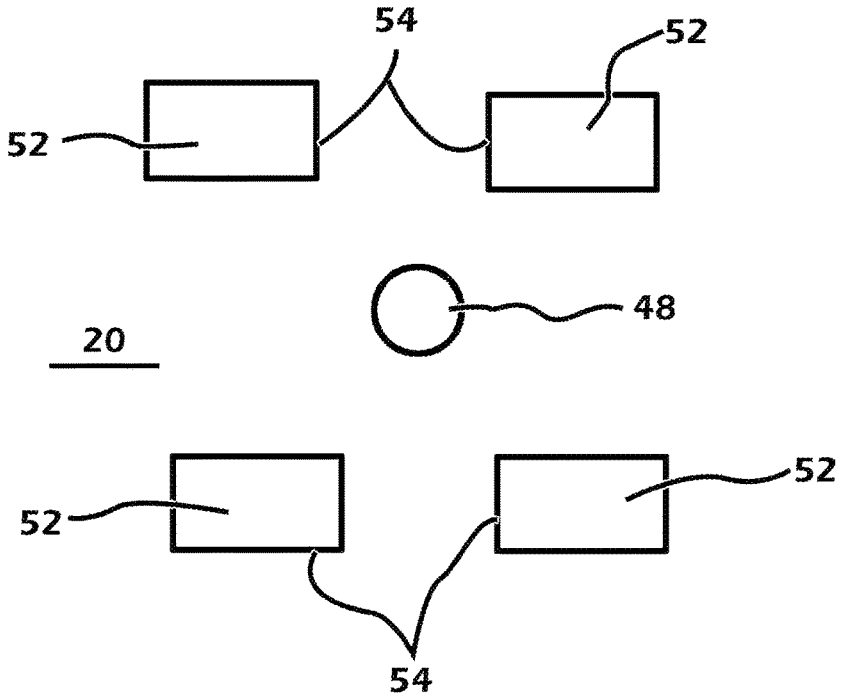

FIG. 9F shows an alternate arrangement where the opening 48 and the indented compartments 52 are formed directly into the playing surface 20 without a disc shaped element. Here, the indented compartments 52 are shown generically as rectangles but could take on any of the shapes disclosed herein and/or different shapes and/or sizes. That is, the opening 48 and recessed area 50 are primarily disclosed herein as both being a part of a disc shaped element 58 that is removable from the playing surface 20. However, in others embodiment, one or both of the opening 48 and recessed area 50 are integrally formed as part of the playing surface 20.

The apparatus 10 may include a single opening 48 and recessed area 50, as disclosed, or a plurality of one or of both of these elements.

Figure 9G:
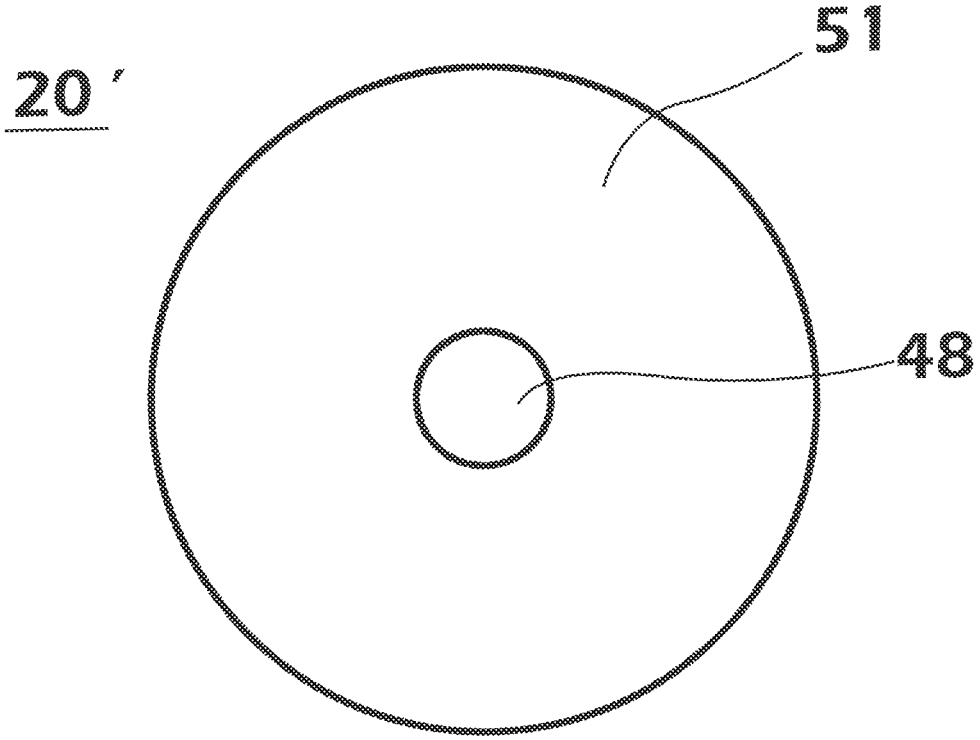

The playing surface 20 has thus far been described as including an opening 48 surrounded by a recessed area 50 which includes one or more indented compartments 52 and complementary raised surfaces 54 that delimit one or more target areas that surround the opening 48. However, in an alternate embodiment, a target area can be co-planar with the playing surface 20. For example, FIG. 9G shows a playing surface 20' having the opening 48 and including a target region 51 arranged therearound. The target region 51 is coplanar with the playing surface 20' and may be drawn or painted or otherwise applied to or formed integrally with the playing surface 20'. In this embodiment, the playing surface 20' and the target region 51 form a flat co-planar surface that extends around the opening 48. FIG. 9G shows an exemplary single circular-shaped target region 51, but the playing surface 20' may include any desired number of co-planar target regions 51, disposed proximate or distal relative to the opening 48, and the target region(s) 51 may have any desired shape and/or color and/or location across the playing surface 20'.

The projectile 42 preferably features a minimal bounce, capable of sliding, rolling, and temporary malleable characteristics. The projectile 42 may comprise, for example, a cloth or leather ball filed with beans, sand, or some other granular substance such as a ball commonly used for juggling.

In playing with the game apparatus 10, one or more players toss the projectile 42 from a predetermined location onto the playing surface 20 in an attempt to pass the projectile through the opening 48 or to retain the projectile on the recessed area 50, for which both actions are awarded certain points. A tossed projectile which enters the front or rear 38, 40 gaps is out of play and a point deduction occurs. The blocking member 62 may be strategically positioned by a player to block a portion of the rear gap 40 and to provide a rebound surface for tossed projectiles. In a multi-player setting, each player has a plurality of projectiles 42 to toss at the playing surface 20. The location of tossed projectiles 42 on the game surface 20 allows for offensive and defensive maneuvers, which either allow or prevent the opposing player's projectiles 42 from going into the opening 48 or staying inside the recessed area 50, or on the game board surface 20.

Various embodiments of the present invention are described herein with reference to the related drawings. Alternative embodiments can be devised without departing from the scope of this invention. It is noted that various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship.

The term "exemplary" is used herein to mean "serving as an example, instance, or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. Terms such as "connected to", "affixed to", etc., can include both an indirect "connection" and a direct "connection."

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed:

1. A projectile toss target game apparatus, comprising:

a planar playing surface arranged at an angle to a ground surface;

an opening formed through the planar playing surface, the opening being of sufficient size and shape to allow passage of the projectile therethrough; and a recessed area formed in the playing surface proximate to the opening, the recessed area being of sufficient size and shape to retain the projectile stationary upon the angled playing surface;

wherein the opening has a circular shape, the recessed area comprises a plurality of arcuate shaped indented compartments extending in a concentric manner around the opening, and wherein the plurality of indented compartments are divided by raised surfaces.

2. The projectile toss target game apparatus of claim 1, wherein the raised surfaces are coplanar with the playing surface and the indented compartments each have a base which extends between the respective raised surfaces where each base is parallel to and non-coplanar with the playing surface.

3. The projectile toss target game apparatus of claim 2, wherein the plurality of arcuate shaped indented compartments comprises four equivalently sized and shaped compartments, each of said compartments bounded by two of said raised surfaces, all of said raised surfaces extending radially from the opening to an outer circumference of the recessed area.

4. The projectile toss target game apparatus of claim 1, further comprising a side wall that extends at least partly around the playing surface and upwardly from the playing surface.

5. The projectile toss target game apparatus of claim 4, further comprising a gap at a rear of the apparatus between a rear edge of the playing surface and the side wall, wherein the gap is configured to receive the projectile when over tossed.

6. The projectile toss target game apparatus of claim 5, wherein the playing surface is rectangular and includes left and right side edges, both having an equivalent length, and a front edge having a same length has the rear edge, wherein the side edges have a length greater than the front and rear edges, and wherein the side walls extend in a linear direction along the left and right side edges and parallel to the rear edge.

7. The projectile toss target game apparatus of claim 6, wherein the gap is delimited by the rear edge of the playing surface, the sidewall which extends parallel to the rear edge and rear portions of the sidewalls at the left and right side of the playing surface.

8. The projectile toss target game apparatus of claim 7, where the sidewall which extends parallel to the rear edge has a height that is greater than the sidewalls at the left and right side of the playing surface.

9. The projectile toss target game apparatus of claim 7, further comprising a first path disposed beneath the playing surface and in communication with the opening and a first receptacle and a second path disposed beneath the playing surface and in communication with the gap and a second receptacle separated from the first receptacle, wherein a projectile that passes through the opening is directed to the first receptacle by the first path and wherein a projectile that passes through the gap is directed to the second receptacle by the second path.

10. The projectile toss target game apparatus of claim 9, further comprising a first viewing pane formed in the playing surface proximate to the first receptacle and a second viewing pane formed in the playing surface proximate to the second receptacle, wherein projectiles disposed in the first receptacle are visible through the first viewing pane and projectiles disposed in the second receptacle are visible through the second viewing pane.

11. The projectile game apparatus of claim 5, further comprising a blocking member removably disposed proximate to the rear edge of the playing surface, wherein the blocking member extends upwardly from the playing surface and is of sufficient height to prevent passage of the over tossed projectile into the gap and to redirect a path of the projectile.

12. The projectile game apparatus of claim 11, wherein the blocking member includes one or more mounting pegs extending from a bottom thereof, wherein the playing surface includes one or more mating apertures for releasably receiving the mounting pegs in order to affix the blocking member in a desired position.

13. The projectile game apparatus of claim 12, further comprising a plurality of said mating apertures corresponding to a plurality of positions in which the blocking member may be affixed.

14. The projectile game apparatus of claim 5, further comprising a support disposed beneath the playing surface that supports the playing surface at a table height relative to the ground surface.

15. A projectile toss target game apparatus, comprising:

a planar playing surface arranged at an angle to a ground surface;

an opening formed through the planar playing surface, the opening being of sufficient size and shape to allow passage of the projectile therethrough; and a recessed area formed in the playing surface proximate to the opening, the recessed area being of sufficient size and shape to retain the projectile stationary upon the angled playing surface;

wherein the opening and the recessed area are formed in a removable portion which is disposed in an aperture in the playing surface.

16. The projectile game apparatus of claim 15, wherein the removable portion is a circular disc shaped element comprising a mounting rim extending around a circumference, the opening disposed centrally, and the recessed area extending concentrically between the opening and the circumference, the recessed area comprising a plurality of arcuate shaped indented compartments divided by radially extending raised surfaces, wherein the raised surfaces are coplanar with the playing surface and the indented compartments each have a base which extends between the respective raised surfaces where each base is parallel to and non-coplanar with the playing surface.

17. A projectile toss target game apparatus, comprising:

a planar playing surface arranged at an angle to a ground surface;

sidewalls extending around sides and a rear of the playing surface and extending upwardly from the playing surface;

an opening formed through the planar playing surface, the opening being of sufficient size and shape to allow passage of the projectile therethrough;

a recessed area formed in the playing surface proximate to the opening, the recessed area being of sufficient size and shape to retain the projectile stationary upon the angled playing surface;

a gap delimited between the rear of the playing surface and the sidewall, wherein the gap is configured to receive the projectile when over tossed; and a blocking member removably disposed proximate to the rear of the playing surface, wherein the blocking member extends upwardly from the playing surface and is of sufficient height to prevent passage of the over tossed projectile into the gap and to redirect a path of the projectile.

18. The projectile toss target game apparatus of claim 17, wherein the opening and the recessed area are formed in a removable portion which is disposed in an aperture in the playing surface, wherein the removable portion is a circular disc shaped element comprising a mounting rim extending around a circumference, the opening disposed centrally, and the recessed area extending concentrically between the opening and the circumference, the recessed area comprising a plurality of arcuate shaped indented compartments divided by radially extending raised surfaces, wherein the raised surfaces are coplanar with the playing surface and the indented compartments each have a base which extends between the respective raised surfaces where each base is parallel to and non-coplanar with the playing surface.

19. A projectile toss target game apparatus, comprising:

a rectangular planar playing surface arranged at an angle to a ground surface;

a support element disposed beneath the playing surface to maintain the playing surface at a table height;

a right sidewall extending along a right side edge of the playing surface, a left sidewall extending along a left side edge of the playing surface, and a rear sidewall extending along a rear edge of the playing surface, the right, left, and rear sidewalls extending upwardly from the playing surface;

a gap delimited between the rear edge of the playing surface and the rear sidewall, wherein the gap is configured to receive the projectile when over tossed;

a blocking member moveable between a plurality of positions proximate to the rear edge of the playing surface, wherein the blocking member extends upwardly from the playing surface and is of sufficient height to prevent passage of the over tossed projectile into the gap and to redirect a path of the projectile;

an aperture formed through the playing surface;

a disc shaped insert mountable within the aperture;

wherein the a disc shaped insert comprises a circular opening at a center thereof;

wherein the disc shaped insert further comprises a recessed area extending concentrically around the opening and comprising a plurality of arcuate shaped indented compartments divided by radially extending raised surfaces, wherein the raised surfaces are coplanar with the playing surface and the indented compartments each have a base which extends between the respective raised surfaces where each base is parallel to and non-coplanar with the playing surface;

wherein the opening is of sufficient size and shape to allow passage of the projectile therethrough and the recessed area is of sufficient size and shape to retain the projectile stationary upon the angled playing surface.

20. A projectile toss target game apparatus, comprising:

a planar playing surface arranged at an angle to a ground surface;

an opening formed through the planar playing surface, the opening being of sufficient size and shape to allow passage of the projectile therethrough; and a recessed area formed in the playing surface proximate to the opening, the recessed area being of sufficient size and shape to retain the projectile stationary upon the angled playing surface;

a side wall that extends at least partly around the playing surface and upwardly from the playing surface; and a gap at a rear of the apparatus between a rear edge of the playing surface and the side wall, wherein the gap is configured to receive the projectile when over tossed.

* * * * *